US008197618B2

(12) United States Patent
Takasugi et al.

(10) Patent No.: US 8,197,618 B2
(45) Date of Patent: Jun. 12, 2012

(54) $NI_3A1$-BASED INTERMETALLIC COMPOUND INCLUDING V AND NB, AND HAVING DUAL MULTI-PHASE MICROSTRUCTURE, PRODUCTION METHOD THEREOF, AND HEAT RESISTANT STRUCTURAL MATERIAL

(75) Inventors: Takayuki Takasugi, Osaka (JP); Yasuyuki Kaneno, Osaka (JP)

(73) Assignee: Osaka Prefecture University Public Corporation, Osaka (JP)

( * ) Notice: Subject to any disclaimer, the term of this patent is extended or adjusted under 35 U.S.C. 154(b) by 874 days.

(21) Appl. No.: 12/087,737

(22) PCT Filed: Nov. 21, 2006

(86) PCT No.: PCT/JP2006/323200

§ 371 (c)(1),
(2), (4) Date: Jul. 14, 2008

(87) PCT Pub. No.: WO2007/086185

PCT Pub. Date: Aug. 2, 2007

(65) Prior Publication Data

US 2009/0120543 A1 May 14, 2009

(30) Foreign Application Priority Data

Jan. 30, 2006 (JP) ..... 2006-021364

(51) Int. Cl.
*C22F 19/03* (2006.01)
*C22C 1/10* (2006.01)

(52) U.S. Cl. ..... 148/675; 148/429

(58) Field of Classification Search ..... 148/675, 148/429; 420/460

See application file for complete search history.

(56) References Cited

U.S. PATENT DOCUMENTS 4,764,226 A 8/1988 Huang et al.

FOREIGN PATENT DOCUMENTS

EP 2 078 763 A1 7/2009

OTHER PUBLICATIONS

Nunomura et al., "Phase relation and microstructure in multi-phase intermetallic alloys based on Ni3Al-Ni3Ti-Ni3V pseudo-ternary alloy system," Intermetallics, vol. 12 2004, pp. 389-399.*

A.I. Taub and R.L. Fleischer, "Intermetallic Compounds for High-Temperature Structural Use", Science, 243 (1989), pp. 616-621.*

(Continued)

*Primary Examiner* — Jessee R. Roe

(74) *Attorney, Agent, or Firm* — Birch, Stewart, Kolasch & Birch, LLP

(57) ABSTRACT

An $Ni_3Al$-based intermetallic compound of the present invention comprises greater than 5 at % and not greater than 13 at % of Al, not less than 9.5 at % and less than 17.5 at % of V, not less than 0 at % and not greater than 5 at % of Nb, not less than 50 weight ppm and not greater than 1000 weight ppm of B, and the remaining portion consisting of Ni and inevitable impurities, and has a dual multi-phase microstructure comprising a primary $L1_2$ phase and an ($L1_2$+$D0_{22}$) eutectoid microstructure.

2 Claims, 16 Drawing Sheets

OTHER PUBLICATIONS

Wataru et al., "Ni3Al-Ni3Nb-Ni3V Gi Sangenkei Gokin no Soshiki to Kikaiteki Seishitsu", The Japan Institute of Metals Koen Gaiyo, vol. 138, Mar. 21, 2006, 2006; p. 301.

Soga et al., "Phase relation and microstructure in multi-phase intermetallic alloys based on Ni3A1-Ni3Nb-Ni3V pseudotamary alloy system", Intermetallics, vol. 14, 2006 pp. 170-179.

Wataru et al., "Ni3Al-Ni3Nb-Ni3V Gi Sangenkei Gokin no Jotaizu to Soshiki", The Japan Institute of Metals Koen Gaiyo, vol. 136, Mar. 29, 2005; p. 201.

Shibuya et al., "Saimitsu Juten Ni3X (X=Al, Ti, V) So kara Naru 2 Jufkuso Oyobi Sanka Tokusei", The japan Institute of Metals Koen Gaiyo, vol. 137, Sep. 26, 2005; p. 93.

Tomihisa et al., "Phase relation and microstructure in $Ni_3A1$-$Ni_3Ti$-$Ni_3Nb$ pseudo-ternary alloy system", Intermetallics, vol. 10, 2002; pp. 247-254.

Examination Report issued on Aug. 25, 2010 in corresponding British patent application.

* cited by examiner

▲ Composition of Alloy Prepared

○ Result of EPMA Analysis

⊡ Result of EPMA Analysis (Average of Two Phases)

····· Tie Line

—— Single-Phase Region

– – Three-Phase Coexistence Region

▲ Composition of Alloy Prepared

⊙ Result of EPMA Analysis

▣ Result of EPMA Analysis (Average of Two Phases)

····· Tie Line

—— Single-Phase Region

– – Three-Phase Coexistence Region $L1_2$+$D0_{22}$

$NI_3A1$-BASED INTERMETALLIC COMPOUND INCLUDING V AND NB, AND HAVING DUAL MULTI-PHASE MICROSTRUCTURE, PRODUCTION METHOD THEREOF, AND HEAT RESISTANT STRUCTURAL MATERIAL

TECHNICAL FIELD

The present invention relates to a $Ni_3Al$-based intermetallic compound with a dual multi-phase microstructure, a production method thereof, and a heat resistant structural material.

BACKGROUND ART

Nowadays, Ni-based superalloys are widely used as high-temperature structural materials for turbine parts of jet engines and gas turbines, etc. The Ni-based superalloys contain metallic phases (γ) exceeding a volume fraction of about 35 vol. % as a constituent phase, and consequently have limitations in melting point and high-temperature creep strength. Intermetallic compounds showing a positive temperature dependence of yield stress are promising materials as the high-temperature structural materials superior to the conventional Ni-based superalloys. However, single-phase materials have drawbacks of poor ductility at room temperature and also low creep strength at high temperature. As to multi-phase materials, because any of $Ni_3X$ type intermetallic compounds has a GCP (geometrically closed packaged) crystal structure, some of such compounds may be combined with high coherency. Many of the $Ni_3X$ type intermetallic compounds have excellent properties. Therefore, by using the $Ni_3X$ type intermetallic compounds, agnew type of multi-phase intermetallic compounds (multi-phase intermetallics) having further excellent properties and a high freedom for microstructural control are expected to be produced.

An attempt has been made to develop a multi-phase intermetallic compound composed of $Ni_3Al(L1_2)$—$Ni_3Ti$ $(D0_{24})$—$Ni_3Nb(D0a)$ system, and it was found that an alloy having excellent properties can be developed (see Non-Patent Document 1).

In Non-Patent Document 2, there has been made a report about a microstructure of a $Ni_3Al(L1_2)$—$Ni_3Nb(D0_a)$—$Ni_3V(D0_{22})$ pseudo-ternary intermetallic compound.

Non-Patent Document 1: K. Tomihisa, Y. Kaneno, T. Takasugi, Intermetallics, Vol. 10(2002), 247-254.

Non-Patent Document 2: W. Soga, Y. Kaneno, T. Takasugi, Intermetallics, Vol. 14(2006), 170-179.

DISCLOSURE OF THE INVENTION

Problems to be Solved by the Invention

It is desirable to provide a material more excellent in mechanical properties than the aforementioned alloys.

In view of the foregoing, the present invention provides an intermetallic compound with excellent mechanical properties at high temperatures.

Means for Solving the Problems and Effects of the Invention

According to the present invention, there is provided an intermetallic compound which comprises greater than 5 at % and not greater than 13 at % of Al, not less than 9.5 at % and less than 17.5 at % of V, not less than 0 at % and not greater than 5 at % of Nb, not less than 50 weight ppm and not greater than 1000 weight ppm of B, and the remaining portion consisting of Ni and inevitable impurities, and has a dual multi-phase microstructure comprising a primary $L1_2$ phase and an $(L1_2+D0_{22})$ eutectoid microstructure (An intermetallic compound having a dual multi-phase microstructure is hereinafter referred to simply as "intermetallic compound").

It has been experimentally confirmed that the inventive intermetallic compound has a dual multi-phase microstructure and exhibits an excellent mechanical properties at high temperatures as will be described later. It has been experimentally confirmed that the inventive intermetallic compound exhibits a far excellent tensile strength and plastic elongation compared with the intermetallic compound described in Non-Patent Document 2 because it contains not less than 50 weight ppm and not greater than 1000 weight ppm of B.

BRIEF DESCRIPTION OF THE DRAWINGS

FIG. 14A is a graph showing relationships between ultimate tensile strength and temperature and FIG. 14B is a graph showing relationships between plastic elongation and temperature.

FIG. 15A is a graph showing relationships between ultimate tensile strength and temperature and FIG. 15B is a graph showing relationships between plastic elongation and temperature.

FIG. 17A is a bright field image, and FIG. 17B is a selected area diffraction pattern for the eutectoid region of the sample.

BEST MODE FOR CARRYING OUT THE INVENTION

The inventive intermetallic compound comprises greater than 5 at % and not greater than 13 at % of Al, not less than 9.5 at % and less than 17.5 at % of V, not less than 0 at % and not greater than 5 at % of Nb, not less than 50 weight ppm and not greater than 1000 weight ppm of B, and the remaining portion consisting of Ni and inevitable impurities, and has a dual multi-phase microstructure comprising a primary $L1_2$ phase and an ($L1_2$+$D0_{22}$) eutectoid microstructure.

Hereinafter, in this specification, the term "not less than X and not greater than Y" may be expressed by the term "X to Y" (namely, these descriptions include boundary values X and Y). Accordingly, for example, "not less than 0 at % and not greater than 5 at %", or "not less than 50 weight ppm and not greater than 1000 weight ppm" are expressed by "0 to 5 at %", or "50 to 1000 weight ppm".

The intermetallic compound is produced by the steps of: performing a first heat-treatment to heat-treat an alloy material comprising greater than 5 at % and not greater than 13 at % of Al, not less than 9.5 at % and less than 17.5 at % of V, 0 to 5 at % of Nb, 50 to 1000 weight ppm of B, and the remaining portion consisting of Ni and inevitable impurities at a primary $L1_2$ phase/A1 phase coexistence temperature at which a primary $L1_2$ phase and an A1 phase coexist, or at a primary $L1_2$ phase/A1 phase/$D0_a$ phase coexistence temperature at which a primary $L1_2$ phase, an A1 phase and a $D0_a$ phase coexist; and cooling the resulting alloy material to an $L1_2$ phase/$D0_{22}$ phase coexistence temperature at which an $L1_2$ phase and a $D0_{22}$ phase coexist, or performing a second heat-treatment to heat-treat the resulting alloy material at the $L1_2$ phase/$D0_{22}$ phase coexistence temperature, whereby the A1 phase is transformed into an ($L1_2$+$D0_{22}$) eutectoid structure to form a dual multi-phase microstructure.

Figure 1:
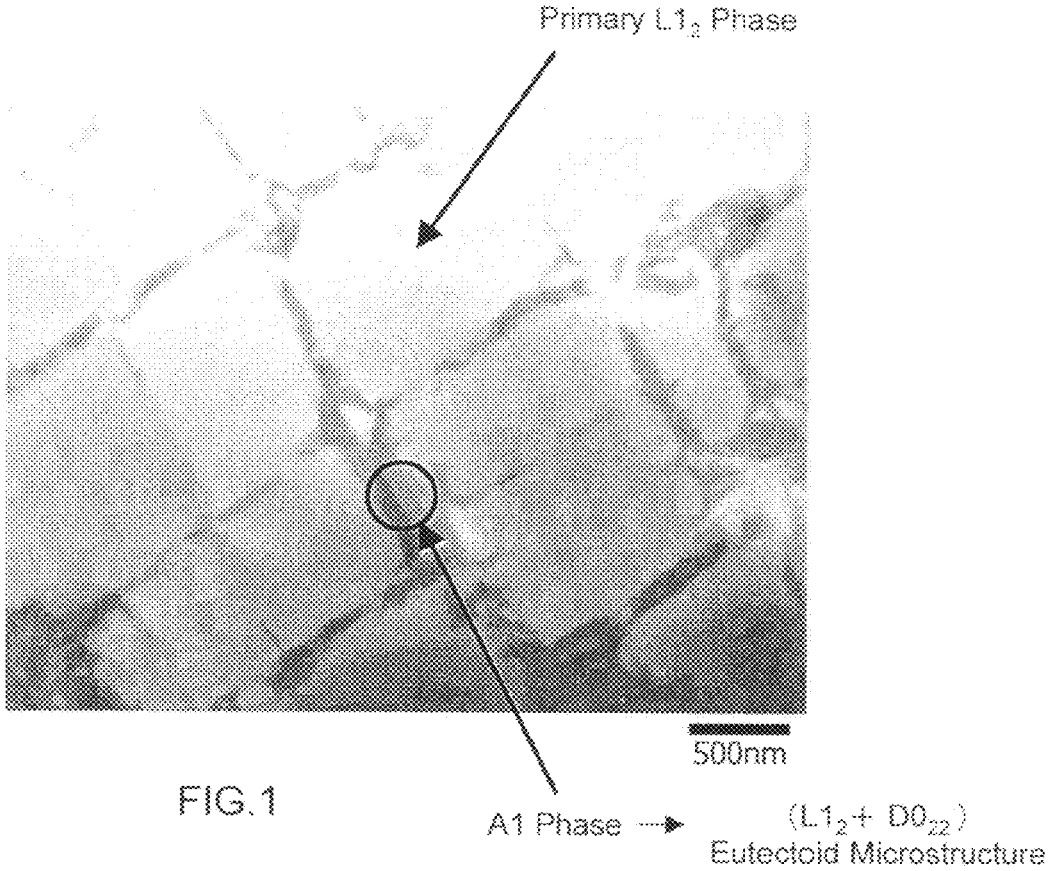
FIG. 1 shows an image of a specific example of the inventive intermetallic compound taken by a TEM (transmission electron microscope), and this is a drawing for explaining the dual multi-phase microstructure of the inventive intermetallic compound.
Figure 2:
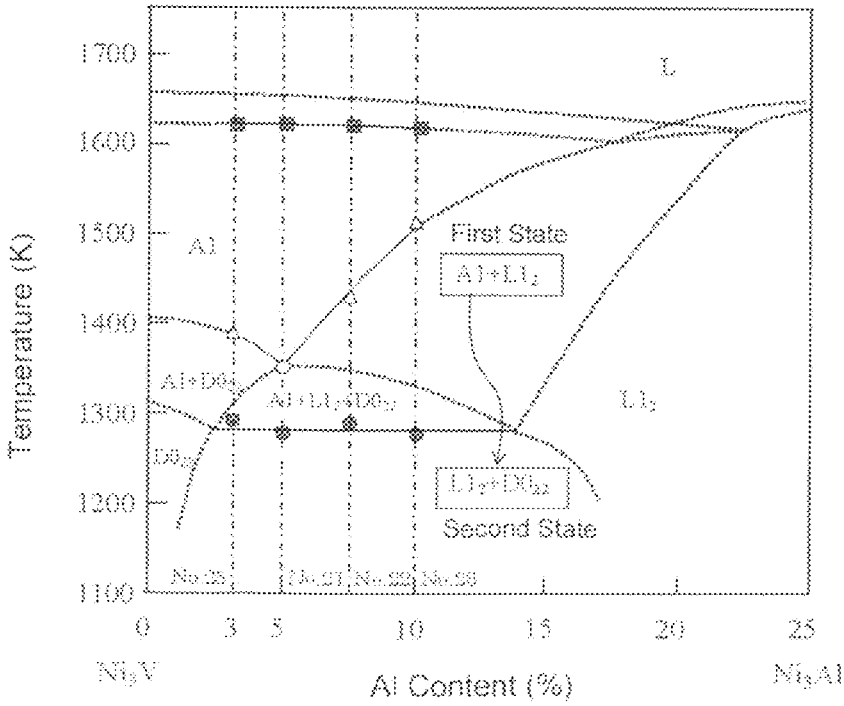
FIG. 2 shows a longitudinal phase diagram of a specific example of the inventive intermetallic compound having a Nb content of 2.5 at % and a V content of (22.5—Al content) at % with the Al content and the temperature being plotted as abscissa and ordinate, respectively, for explaining the dual multi-phase microstructure of the inventive intermetallic compound.

Here, the inventive intermetallic compound having the dual multi-phase microstructure and the production method thereof will be described with reference to TEM images (FIG. 1) and a longitudinal phase diagram (FIG. 2). FIG. 1 is a TEM image of a specific example of the inventive intermetallic compound. FIG. 2 is a longitudinal phase diagram for a specific example of the inventive intermetallic compound with the Al content and the temperature being plotted as abscissa and ordinate, respectively. The Nb content is a value of 2.5 at %, and the V content is (22.5—Al content) at %.

First, the alloy material is subjected to the first heat-treatment. The first heat-treatment is performed at a primary $L1_2$ phase/A1 phase coexistence temperature, or at a primary $L1_2$ phase/A1 phase/$D0_a$ phase coexistence temperature. As an example, a temperature of the first heat-treatment is a temperature at which the sample is in a first state shown in FIG. 2. The $L1_2$ phase is a $Ni_3Al$ intermetallic phase, the A1 phase is an fcc solid solution phase, and the $D0_a$ phase is a $Ni_3Nb$ intermetallic phase. Referring to FIG. 1, a cuboidal primary $L1_2$ phase is dispersed, and an A1 phase exists between the primary $L1_2$ phase and the primary $L1_2$ phase. A microstructure comprising the primary $L1_2$ phase and the A1 phase between the primary $L1_2$ phase and the primary $L1_2$ phase is hereinafter referred to as "upper multi-phase microstructure."

Next, the alloy material subjected to the first heat-treatment is cooled to the $L1_2$ phase/$D0_{22}$ phase coexistence temperature, or further subjected to the second heat-treatment at the $L1_2$ phase/$D0_{22}$ phase coexistence temperature. The cooling may be natural cooling or forcible cooling such as water-quenching. The natural cooling may be achieved, for example, by taking out the alloy material from a heat-treatment furnace after the first heat-treatment and then allowing the resulting alloy material to be put at room temperature, or by turning off a heater of the heat-treatment furnace after the first heat-treatment and then allowing the resulting alloy material to be put in the heat-treatment furnace. A temperature for the second heat-treatment is, for example, about 1173 to about 1273 K. A period for the second heat-treatment is, for example, about 5 to 200 hours. The A1 phase may be decomposed into the $L1_2$ phase and the $D0_{22}$ phase by the cooling such as the water-quenching without the second heat-treatment. However, the decomposition can be more reliably achieved by the heat-treatment at the relatively high temperature. After the second heat-treatment, the resulting alloy material may be cooled to the room temperature by natural cooling or forcible cooling.

"The $L1_2$ phase/$D0_{22}$ phase coexistence temperature" is a temperature at which the sample is in a second state shown in FIG. 2, i.e., a temperature not higher than a temperature defined by plots • in FIG. 2 (in FIG. 2, 1281 K, which may vary depending on the composition of the alloy material). This cooling hardly influences the primary $L1_2$ phase, but decomposes the A1 phase into the $L1_2$ phase and the $D0_{22}$ phase. A multi-phase microstructure comprising the $L1_2$ phase and the $D0_{22}$ phase provided by the decomposition of the A1 phase is hereinafter referred to as "lower multi-phase microstructure."

The inventive intermetallic compound has the dual multi-phase microstructure consisting of the upper multi-phase microstructure and the lower multi-phase microstructure. It has been experimentally confirmed that the inventive intermetallic compound is excellent in mechanical properties at high temperatures as will be described later. These excellent properties are supposed to be due to the dual multi-phase microstructure of the inventive intermetallic compound. Since the inventive intermetallic compound is excellent in mechanical properties at high temperatures, the intermetallic compound is usable as a heat resistant structural material.

A reason why the Al content is defined to be greater than 5 at % and not greater than 13 at % and the V content is defined to be not less than 9.5 at % and less than 17.5 at % is because the first heat-treatment at the primary $L1_2$ phase/A1 phase coexistence temperature or at a primary $L1_2$ phase/A1 phase/$D0_a$ phase coexistence temperature and the cooling to the $L1_2$ phase/$D0_{22}$ phase coexistence temperature or the second heat-treatment at the $L1_2$ phase/$D0_{22}$ phase coexistence temperature can result in the dual multi-phase microstructure as will be understood from the longitudinal phase diagram of FIG. 2 and the following specific examples.

A specific value of the Al content (content percentage) may be greater than 5 at % and not greater than 13 at %, for example, 5.5, 6, 6.5, 7, 7.5, 8, 8.5, 9, 9.5, 10, 10.5, 11, 11.5, 12, 12.5 or 13 at %.

A specific value of the V content may be not less than 9.5 at % and less than 17.5 at %, for example, 9.5, 10, 10.5, 11, 11.5, 12, 12.5, 13, 13.5, 14, 14.5, 15, 15.5, 16, 16.5 or 17 at %.

The Al content and the V content may each take a value between any two values of the aforementioned specific values.

A specific value of the Nb content may be 0 to 5 at %, for example, 0, 0.5, 1, 1.5, 2, 2.5, 3, 3.5, 4, 4.5 or 5 at %. The Nb content may take a value between any two values of the aforementioned specific values. The intermetallic compound or the alloy material according to the present invention preferably contains Nb, but may contain no Nb.

The Ni content is preferably 73 to 77 at %, more preferably 74 to 76 at %. With the Ni content being in this range, the ratio of the Ni content and the total of the Al, Nb and V contents is close to 3:1, so that a solid solution phase of Ni, Al, Nb or V is hardly present. A specific value of the Ni content may be, for example, 73, 73.5, 74, 74.5, 75, 75.5, 76, 76.5 or 77 at %. The Ni content may take a value between any two values of the aforementioned specific values.

Specific examples of the composition of the inventive intermetallic compound include:

73Ni-10Al-17V, 73Ni-13Al-14V, 73Ni-7.5Al-17V-2.5Nb, 73Ni-10Al-14.5V-2.5Nbi, 73Ni-13Al-11.5V-2.5Nb, 73Ni-5.5Al-16.5V-5Nb,

73Ni-9Al-13V-5Nb and 73Ni-13Al-9V-5Nb;

75Ni-8Al-17V, 75Ni-10Al-15V, 75Ni-13Al-12V, 75Ni-5.5Al-17V-2.5Nb, 75Ni-9.5Al-13V-2.5Nb, 75Ni-13Al-9.5V-2.5Nb,

75Ni-5.5Al-14.5V-5Nb, 75Ni-8Al-12V-5Nb and 75Ni-10.5Al-9.5V-5Nb; and

77Ni-6Al-17V, 77Ni-9Al-14V, 77Ni-13Al-10V, 77Ni-5.5Al-15V-2.5Nb, 77Ni-8Al-12.5V-2.5Nb, 77Ni-11Al-9.5V-2.5Nb,

77Ni-5.5Al-12.5V-5Nb, 77Ni-7Al-11V-5Nb and 77Ni-8.5Al-9.5V-5Nb;

wherein a numeral preceding each element means a percentage of the element in atomic percentage (at %).

A specific value of the B content may be 50 to 1000 weight ppm, for example, 50, 100, 150, 200, 250, 300, 350, 400, 450, 500, 550, 600, 650, 700, 750, 800, 850, 900, 950 or 1000 weight ppm. The B content may take a value between any two values of the aforementioned specific values.

Specific examples of the composition of an embodiment of the inventive intermetallic compound include:

preferably, 6 to 10 at % of Al, 12 to 16.5 at % of V, 1 to 4.5 at % of Nb, 200 to 800 weight ppm of B, and the remaining portion consisting of Ni and inevitable impurities, more preferably, 6.5 to 9.5 at % of Al, 12.5 to 16 at % of V, 1.5 to 4 at % of Nb, 300 to 700 weight ppm of B, and the remaining portion consisting of Ni and inevitable impurities, and furthermore preferably, 7 to 9 at % of Al, 13 to 15.5 at % of V, 2 to 3.5 at % of Nb, 400 to 600 weight ppm of B, and the remaining portion consisting of Ni and inevitable impurities. In this case, it is because tensile strength becomes high (see Table 4 and FIG. 14).

The present invention, from another point of view, also provides a production method of a $Ni_3Al$-based intermetallic compound, comprising the steps of: performing a first heat-treatment to heat-treat an alloy material comprising greater than 5 at % and not greater than 13 at % of Al, not less than 9.5 at % and less than 17.5 at % of V, 0 to 5 at % of Nb, 0 to 1000 weight ppm of B, and the remaining portion consisting of Ni and inevitable impurities at a primary $L1_2$ phase/A1 phase coexistence temperature at which a primary $L1_2$ phase and an A1 phase coexist, or at a primary $L1_2$ phase/A1 phase/$D0_a$ phase coexistence temperature at which a primary $L1_2$ phase, an A1 phase and a $D0_a$ phase coexist; and performing a second heat-treatment to heat-treat the resulting alloy material at an $L1_2$ phase/$D0_{22}$ phase coexistence temperature at which an $L1_2$ phase and a $D0_{22}$ phase coexist, whereby the A1 phase is transformed into an ($L1_2$+$D0_{22}$) eutectoid structure to form a dual multi-phase microstructure.

This production method is similar to the aforementioned production method, but it is different from the aforementioned production method in that (1) the specific value of the B content is 0 to 1000 weight ppm and (2) the second heat-treatment at an $L1_2$ phase/$D0_{22}$ phase coexistence temperature is essential. An effect of performing the second heat-treatment is as described above.

A specific value of the B content may be 0 to 1000 weight ppm, for example, 0, 50, 100, 150, 200, 250, 300, 350, 400, 450, 500, 550, 600, 650, 700, 750, 800, 850, 900, 950 or 1000 weight ppm. The B content may take a value between any two values of the aforementioned specific values.

EXAMPLES

The inventive intermetallic compound will hereinafter be explained by way of various specific examples thereof. In the following experiments, the intermetallic compound with a dual multi-phase microstructure was prepared by heat-treating cast materials, and the mechanical properties of the resulting intermetallic compound were examined.

For the following specific examples, heat-treatment at 1373 K corresponds to the first heat-treatment at the primary $L1_2$ phase/A1 phase coexistence temperature, or at the primary $L1_2$ phase/A1 phase/$D0_a$ phase coexistence temperature, and water-quenching following the heat-treatment at 1373 K corresponds to the cooling to the $L1_2$ phase/$D0_{22}$ phase coexistence temperature. A heat-treatment at 1273 K following the heat-treatment at 1373 K corresponds to the second heat-treatment at the $L1_2$ phase/$D0_{22}$ phase coexistence temperature.

1. Method of Preparing Cast Materials

Cast materials were prepared by melting and casting raw metals of Ni, Al, Nb and V (each having a purity of 99.9 wt%) in proportions as shown in the rows of No. 1 to No. 20 in Tables 1 and 2 in a mold in an arc melting furnace. A melting chamber of the arc melting furnace was first evacuated, and the atmosphere in the arc melting furnace is replaced with an inert gas (argon gas). Non-consumable tungsten electrodes were employed as electrodes of the furnace, and a water-cooling copper hearth was employed as a mold. In the following description, the cast materials will be referred to as Samples.

In Tables 1 and 2, Samples No. 6, No. 9, No. 13, No. 14 and No. 15 were examples of the present invention. Further, Samples No. 22 and No. 23 in Table 4 described later were also examples of the present invention.

The samples according to the examples of the present invention are located in: (1) a two-phase coexistence region including an $L1_2$ phase and an A1 phase or a three-phase coexistence region including an $L1_2$ phase, an A1 phase and a $D0_a$ phase in a phase diagram at 1373 K shown in FIG. 6 to be described later; and (2) a two-phase coexistence region including an $L1_2$ phase and a $D0_{22}$ phase or a three-phase coexistence region including an $L1_2$ phase, a $D0_{22}$ phase and a $D0_a$ phase in a phase diagram at 1273 K shown in FIG. 5 to be described later.

These samples are each imparted with the dual multi-phase microstructure by: (1) forming the primary $L1_2$ phase and the A1 phase through the first heat-treatment at the relatively high temperature; and (2) decomposition of the A1 phase into the $L1_2$ phase and the $D0_{22}$ phase through the subsequent cooling or the subsequent heat-treatment at the relatively low temperature.

TABLE 1

| | Composition of alloy (at. %) | | | | Constituent phase | $L1_2$ ($Ni_3Al$) (at. %) | | | | $D0_a$ ($Ni_3Nb$) (at. %) | | | | $D0_{22}$ ($Ni_3V$) (at. %) | | | |
|---|---|---|---|---|---|---|---|---|---|---|---|---|---|---|---|---|---|
| Alloy | Ni | Al | Nb | V | at1273K | Ni | Al | Nb | V | Ni | Al | Nb | V | Ni | Al | Nb | V |
| 1 | 75 | 2.5 | 5 | 17.5 | $D0_a + D0_{22}$ | — | — | — | — | 75.2 | 0.457 | 7.46 | 16.9 | 75.1 | 1.62 | 3.04 | 20.3 |
| 2 | 75 | 2.5 | 10 | 12.5 | $L1_2 + D0_a + D0_{22}$ | ND | ND | ND | ND | 75.4 | 0.774 | 10.7 | 13.1 | ND | ND | ND | ND |
| 3 | 75 | 5 | 5 | 15 | $L1_2 + D0_a + D0_{22}$ | ND | ND | ND | ND | 77.0 | 0.612 | 6.38 | 16.1 | 77.6 | 2.76 | 2.27 | 17.4 |
| 4 | 75 | 5 | 10 | 10 | $L1_2 + D0_a$ | ND | ND | ND | ND | 76.5 | 0.813 | 11.9 | 10.8 | — | — | — | — |
| 5 | 75 | 5 | 15 | 5 | $L1_2 + D0_a$ | 75.6 | 14.7 | 6.12 | 3.58 | 75.9 | 1.86 | 12.2 | 10.0 | — | — | — | — |
| 6 | 75 | 7.5 | 5 | 12.5 | $L1_2 + D0_a + D0_{22}$ | ND | ND | ND | ND | 74.9 | 1.05 | 7.61 | 16.5 | ND | ND | ND | ND |
| 7 | 75 | 7.5 | 10 | 7.5 | $L1_2 + D0_a$ | ND | ND | ND | ND | 76.7 | 1.30 | 13.9 | 8.12 | — | — | — | — |
| 8 | 75 | 7.5 | 15 | 2.5 | $L1_2 + D0_a$ | 74.5 | 16.1 | 6.67 | 2.63 | 76.4 | 1.70 | 19.2 | 2.65 | — | — | — | — |
| 9 | 75 | 10 | 5 | 10 | $L1_2 + D0_a + D0_{22}$ | ND | ND | ND | ND | 75.1 | 0.889 | 9.76 | 14.3 | ND | ND | ND | ND |
| 10 | 75 | 10 | 10 | 5 | $L1_2 + D0_a$ | 74.5 | 15.4 | 5.75 | 4.3 | 76.3 | 2.01 | 15.6 | 6.10 | — | — | — | — |
| 11 | 75 | 12.5 | 5 | 7.5 | $L1_2 + D0_a$ | 75.4 | 14.0 | 3.90 | 6.7 | 75.9 | 1.86 | 12.2 | 10.0 | — | — | — | — |
| 12 | 75 | 12.5 | 10 | 2.5 | $L1_2 + D0_a$ | 74.1 | 16.6 | 6.66 | 2.61 | 75.9 | 1.93 | 19.3 | 3.65 | — | — | — | — |
| 13 | 75 | 8.75 | 1 | 15.25 | $L1_2 + D0_{22}$ | ND | ND | ND | ND | — | — | — | — | ND | ND | ND | ND |
| 14 | 75 | 8.75 | 2 | 14.25 | $L1_2 + D0_{22}$ | ND | ND | ND | ND | — | — | — | — | ND | ND | ND | ND |
| 15 | 75 | 8.75 | 3 | 13.25 | $L1_2 + D0_a + D0_{22}$ | ND | ND | ND | ND | 74.3 | 0.869 | 7.30 | 17.5 | ND | ND | ND | ND |
| 16 | 75 | 1.25 | 5 | 18.75 | $D0_a + D0_{22}$ | — | — | — | — | 74.7 | 0.218 | 7.20 | 17.7 | 74.8 | 0.701 | 2.65 | 21.8 |
| 17 | 75 | 3.75 | 5 | 16.25 | $L1_2 + D0_a + D0_{22}$ | ND | ND | ND | ND | 75.5 | 0.960 | 7.61 | 15.9 | 75.2 | 3.74 | 3.27 | 17.8 |
| 18 | 75 | 12.5 | 4 | 8.5 | $L1_2 + D0_a + D0_{22}$ | ND | ND | ND | ND | ND | ND | ND | ND | ND | ND | ND | ND |
| 19 | 75 | 13.75 | 4 | 7.25 | $L1_2 + D0_a + D0_{22}$ | ND | ND | ND | ND | ND | ND | ND | ND | ND | ND | ND | ND |
| 20 | 75 | 15 | 4 | 6 | $L1_2 + D0_a$ | ND | ND | ND | ND | ND | ND | ND | ND | — | — | — | — |

TABLE 2

| | Composition of Alloy (at. %) | | | | Constituent phase | $L1_2$ ($Ni_3Al$) (at. %) | | | | $D0_a$ ($Ni_3Nb$) (at. %) | | | | A1 ($Ni_3V$) (at. %) | | | |
|---|---|---|---|---|---|---|---|---|---|---|---|---|---|---|---|---|---|
| Alloy | Ni | Al | Nb | V | at 1373K | Ni | Al | Nb | V | Ni | Al | Nb | V | Ni | Al | Nb | V |
| 1 | 75 | 2.5 | 5 | 17.5 | $D0_a + A1$ | — | — | — | — | 74.4 | 0.631 | 7.06 | 17.9 | 75.7 | 2.16 | 2.28 | 19.7 |
| 2 | 75 | 2.5 | 10 | 12.5 | $D0_a + A1$ | — | — | — | — | 75.6 | 0.418 | 11.1 | 12.9 | 78.5 | 2.08 | 3.03 | 16.4 |
| 3 | 75 | 5 | 5 | 15 | $D0_a + A1$ | — | — | — | — | 74.9 | 0.900 | 8.00 | 16.2 | 75.6 | 3.22 | 2.44 | 18.7 |
| 4 | 75 | 5 | 10 | 10 | $L1_2 + D0_a + A1$ | ND | ND | ND | ND | 75.8 | 1.10 | 11.7 | 11.4 | 77.7 | 4.62 | 3.53 | 14.4 |
| 6 | 75 | 7.5 | 5 | 12.5 | $L1_2 + D0_a + A1$ | ND | ND | ND | ND | 74.7 | 1.17 | 8.87 | 15.3 | 76.2 | 4.31 | 2.50 | 16.9 |
| 7 | 75 | 7.5 | 10 | 7.5 | $L1_2 + D0_a$ | ND | ND | ND | ND | 76.0 | 1.14 | 13.3 | 9.59 | ND | ND | ND | ND |
| 9 | 75 | 10 | 5 | 10 | $L1_2 + D0_a + A1$ | ND | ND | ND | ND | 75.4 | 1.27 | 9.26 | 14.1 | 76.6 | 4.67 | 2.91 | 15.9 |
| 10 | 75 | 10 | 10 | 5 | $L1_2 + D0_a$ | 77.3 | 13.8 | 4.17 | 4.74 | 76.3 | 1.35 | 15.6 | 6.69 | — | — | — | — |
| 11 | 75 | 12.5 | 5 | 7.5 | $L1_2 + D0_a$ | ND | ND | ND | ND | 76.3 | 1.27 | 12.5 | 10.1 | — | — | — | — |
| 12 | 75 | 12.5 | 10 | 2.5 | $L1_2 + D0_a$ | 76.2 | 14.8 | 6.27 | 2.68 | 76.9 | 0.954 | 19.0 | 3.20 | — | — | — | — |
| 13 | 75 | 8.75 | 1 | 15.25 | $L1_2 + A1$ | ND | ND | ND | ND | — | — | — | — | ND | ND | ND | ND |
| 14 | 75 | 8.75 | 2 | 14.25 | $L1_2 + A1$ | ND | ND | ND | ND | — | — | — | — | ND | ND | ND | ND |
| 15 | 75 | 8.75 | 3 | 13.25 | $L1_2 + D0_a + A1$ | ND | ND | ND | ND | ND | ND | ND | ND | ND | ND | ND | ND |
| 16 | 75 | 1.25 | 5 | 18.75 | $D0_a + A1$ | — | — | — | — | 75.4 | 0.0988 | 5.58 | 19.0 | 77.2 | 0.331 | 1.89 | 20.6 |
| 17 | 75 | 3.75 | 5 | 16.25 | $D0_a + A1$ | — | — | — | — | 74.3 | 0.758 | 8.00 | 17.0 | 75.4 | 2.72 | 2.25 | 19.7 |
| 18 | 75 | 12.5 | 4 | 8.5 | $L1_2 + D0_a$ | ND | ND | ND | ND | ND | ND | ND | ND | — | — | — | — |
| 19 | 75 | 13.75 | 4 | 7.25 | $L1_2 + D0_a$ | ND | ND | ND | ND | ND | ND | ND | ND | — | — | — | — |
| 20 | 75 | 15 | 4 | 6 | $L1_2 + D0_a$ | ND | ND | ND | ND | ND | ND | ND | ND | — | — | — | — |

2. Isothermal Phase Diagram

Figure 3A:
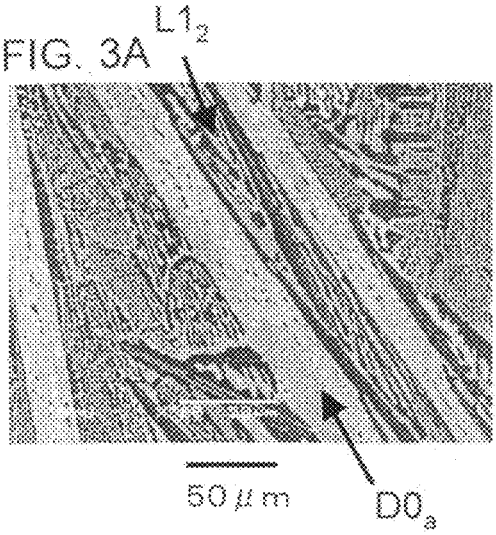
FIGS. 3A to 3D show SEM images of samples of No. 8, No. 16, No. 14 and No. 6, respectively, as specific examples of the inventive intermetallic compound, which were heat-treated at 1273 K for 7 days followed by water-quenching.
Figure 3B:
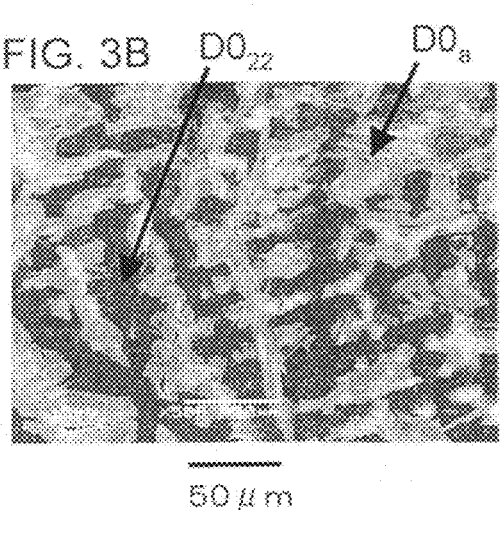
Figure 3C:
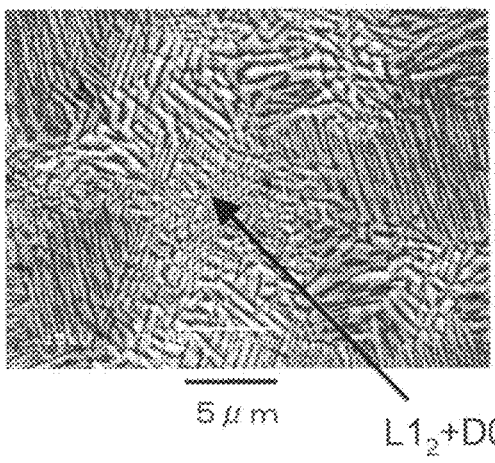
Figure 3D:
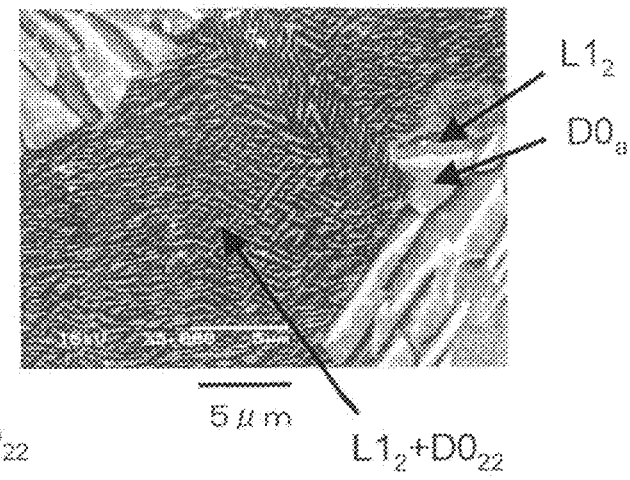
Figure 4A:
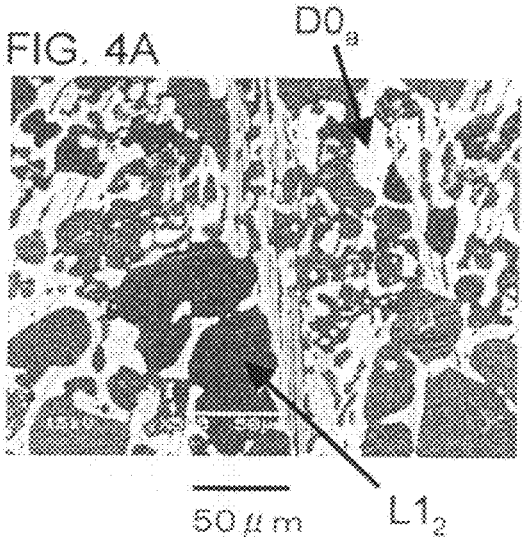
FIGS. 4A to 4D show SEM images of samples of No. 10, No. 17, No. 13 and No. 9, respectively, as specific examples of the inventive intermetallic compound, which were heat-treated at 1373 K for 7 days followed by water-quenching.
Figure 4B:
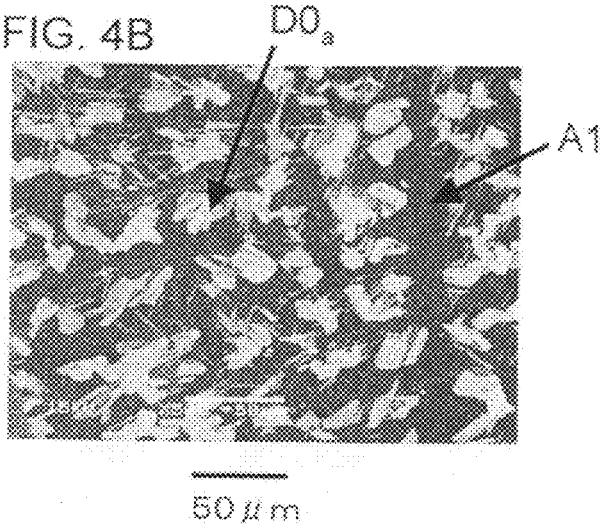
Figure 4C:
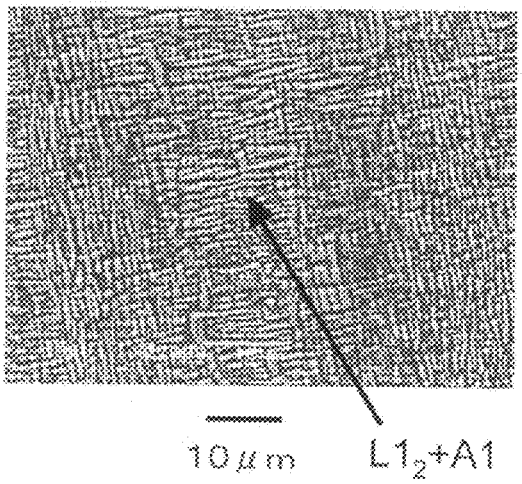
Figure 4D:
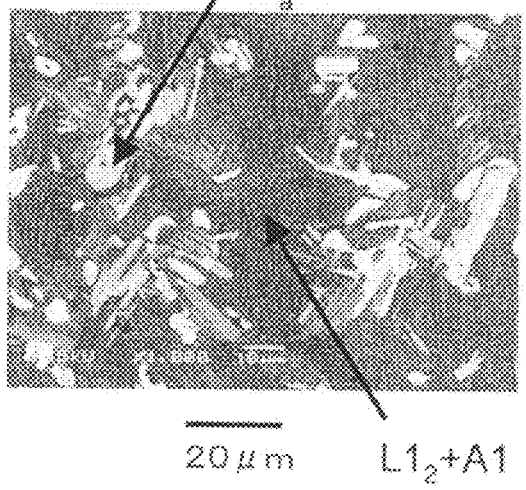

Samples No. 1 to No. 20 were sealed in an evacuated quartz tube, and then heat-treated at 1273 K for 7 days or at 1373 K for 7 days followed by water-quenching. Thereafter, the microstructures of Samples No. 1 to No. 20 were observed and the composition of the constituent phases of Samples No. 1 to No. 20 were analyzed for determination of isothermal phase diagrams at 1273 K and 1373 K. An OM (Optical Microscope) and a SEM (Scanning Electron Microscope) were used for the observation of the microstructures, and a SEM-EPMA (Scanning Electron Microscope-Electron Probe Micro Analyzer) and an XRD (X-ray diffraction) were used for the composition analysis of the constituent phases. The results of the observation and the composition analysis at 1273 K and 1373 K are shown in Tables 1 and 2. Typical SEM images of Samples heat-treated at 1273 K and 1373 K are shown in FIGS. 3A to 3D, and FIGS. 4A to 4D, respectively. FIGS. 3A to 3D are SEM images of samples No. 8, No. 16, No. 14 and No. 6, respectively, and FIGS. 4A to 4D are SEM images of samples No. 10, No. 17, No. 13 and No. 9, respectively. There were large differences in microstructure of the samples depending on the composition. In FIG. 3C, there was formed a checkerboard pattern in which the $L1_2$ ($Ni_3Al$) phase and the $D0_{22}$ ($Ni_3V$) phase are finely precipitated from a high temperature Al (fcc) phase by a eutectoid reaction. Further, in FIG. 4C, there was formed the so-called superalloy microstructure comprising the $L1_2$ ($Ni_3Al$) phase and the Al (fcc) phase.

Figure 5:
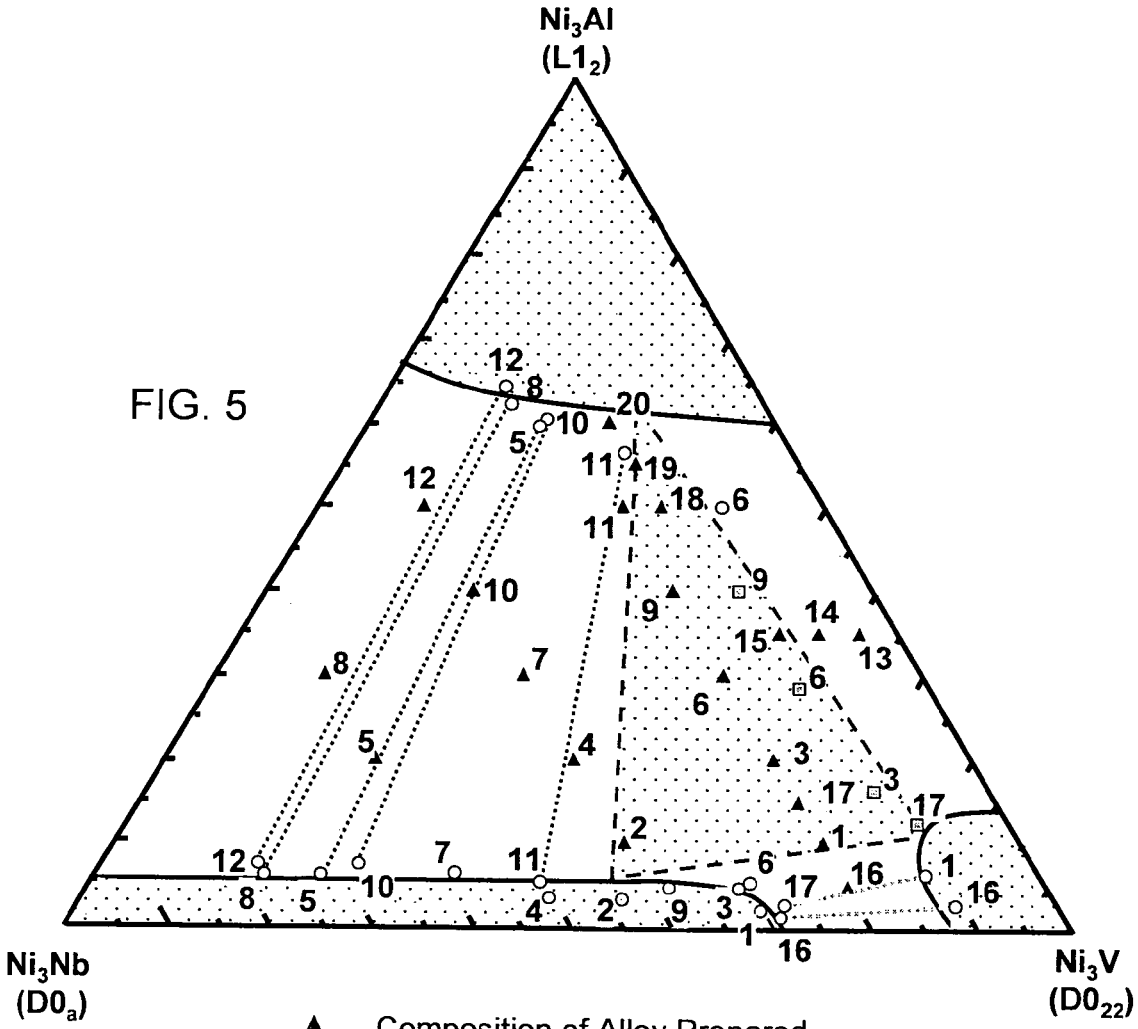
FIG. 5 shows an isothermal phase diagram of a $Ni_3Al$—$Ni_3Nb$—$Ni_3V$ pseudo-ternary alloy at 1273 K where alloy compositions of specific examples of the inventive intermetallic compound are plotted.
Figure 6:
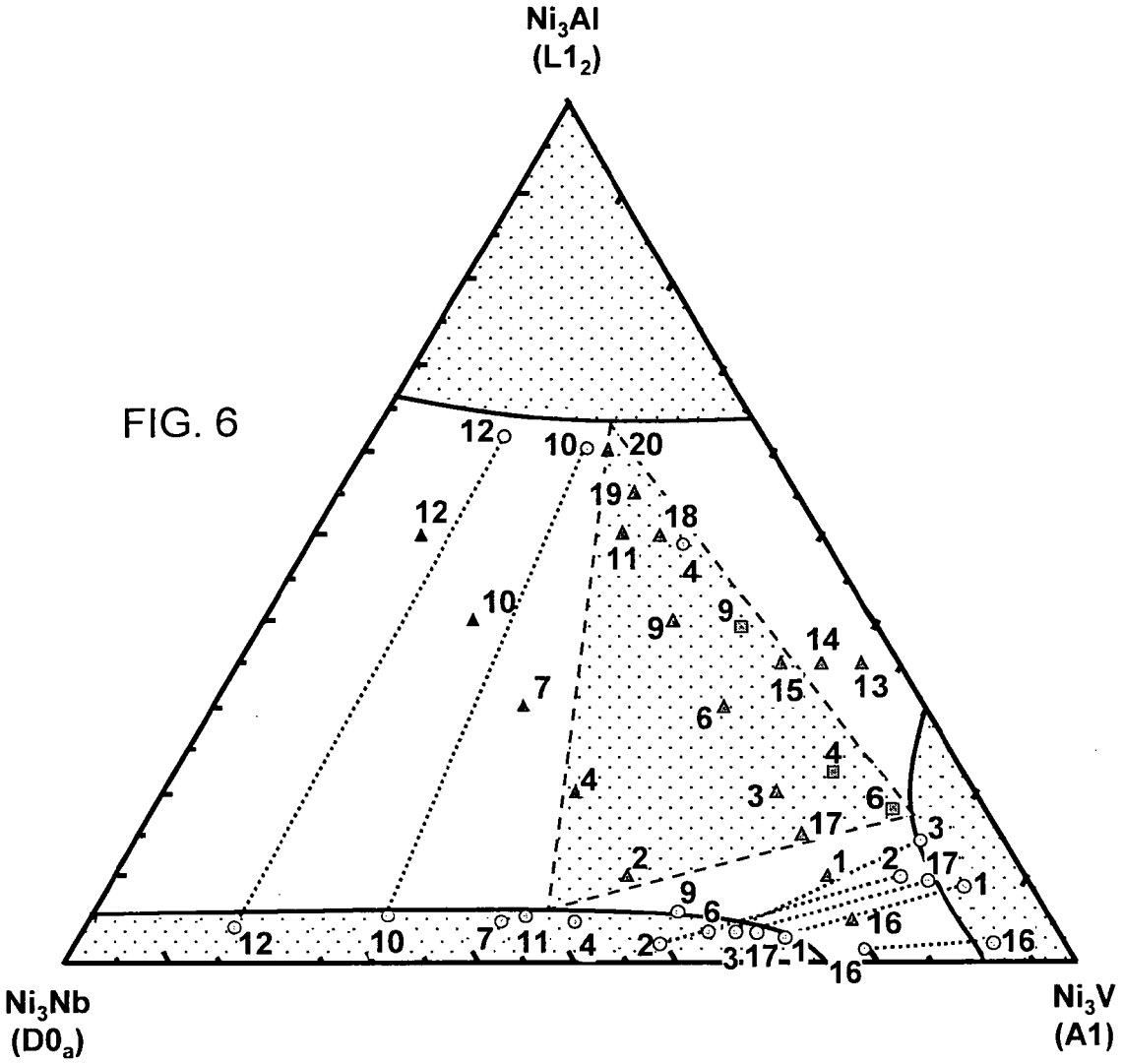
FIG. 6 shows an isothermal phase diagram of a $Ni_3Al$—$Ni_3Nb$—$Ni_3V$ pseudo-ternary alloy at 1373 K where alloy compositions of specific examples of the inventive intermetallic compound are plotted.

In turn, the isothermal phase diagrams at 1273 K and 1373 K obtained from the results of the SEM-EPMA analysis and the XRD measurement are shown in FIG. 5 and FIG. 6, respectively. A phase is not found other than the $L1_2$ ($Ni_3Al$), $D0_a$ ($Ni_3Nb$), and $D0_{22}$ ($Ni_3V$), previously reported, and each phase is in a single-phase or multi-phase equilibrium state. In the phase diagram at 1273 K, each phase field expands in parallel with a $Ni_3Nb$—$Ni_3V$ pseudo-binary line on the whole, and the $Ni_3Nb$ phase extended up to a field where Nb is replaced with V in large quantity (about 70 at %). Further, an aluminum element hardly becomes a solid solution in both $D0_a$ ($Ni_3Nb$) phase and $D0_{22}$ ($Ni_3V$) phase and a solid-solubility limit of the $L1_2$ ($Ni_3Al$) phase expands substantially in parallel with the $Ni_3Nb$—$Ni_3V$ pseudo-binary line. In the phase diagram at 1373 K, the Al (fcc) phase expanded along the $Ni_3Al$—Al($Ni_3V$) pseudo-binary line rather than the $Ni_3Nb$—Al (fcc) pseudo-binary line compared with that in the phase diagram at 1273 K. This is supposedly because the Al element having an fcc lattice stabilizes the Al (fcc) phase more than the Nb element having a bcc lattice. On the other hand, the phase fields of the $L1_2$ phase and the $D0_a$ phase are almost the same as those of the phase diagram at 1273 K.

3. Discussion of Isothermal Phase Diagram

Here, a reason why the isothermal phase diagram shown in Table 5 has features described above is discussed using the electron concentration (e/a) and the atomic radius ratio ($R_x/R_{Ni}$). It is well known that the phase field and the phase stability of a $Ni_3X$ type intermetallic compound having a GCP structure are closely related with the electron concentration (e/a) and the atomic radius ratio ($R_x/R_{Ni}$). The electron concentrations and the atomic radius ratios of a $Ni_3X$ intermetallic compound phase, investigated in this experimental research, are shown in Table 3.

TABLE 3

| | $Ni_3X$ | | |
|---|---|---|---|
| | $Ni_3Al$ ($L1_2$) | $Ni_3Nb$ ($D0_a$) | $Ni_3V$ ($D0_{22}$) |
| Atomic arrangement in stacking order | cT | hR | cR |
| Electron concentration (e/a) | 8.25 | 8.75 | 8.75 |
| Atomic radius ratio ($R_x/R_{Ni}$) | 1.149 | 1.185 | 1.084 |

Figure 7A:
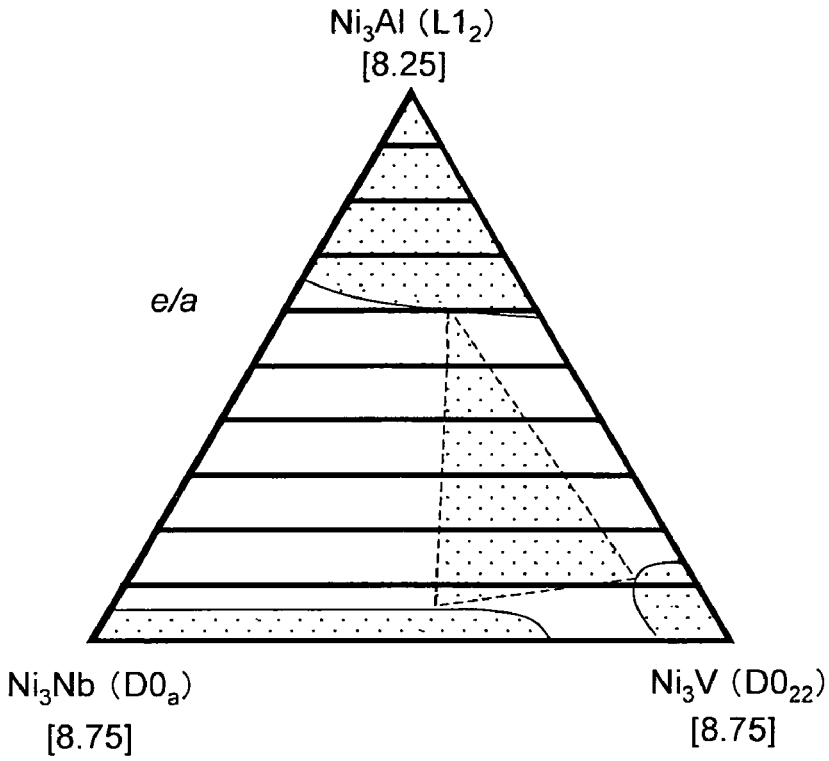
FIGS. 7A and 7B are contour maps of electron concentration (e/a) and atomic radius ratio $(R_x/R_{Ni})$ for a $Ni_3Al$—$Ni_3Nb$—$Ni_3V$ pseudo-ternary alloy of the inventive intermetallic compound, respectively.
Figure 7B:
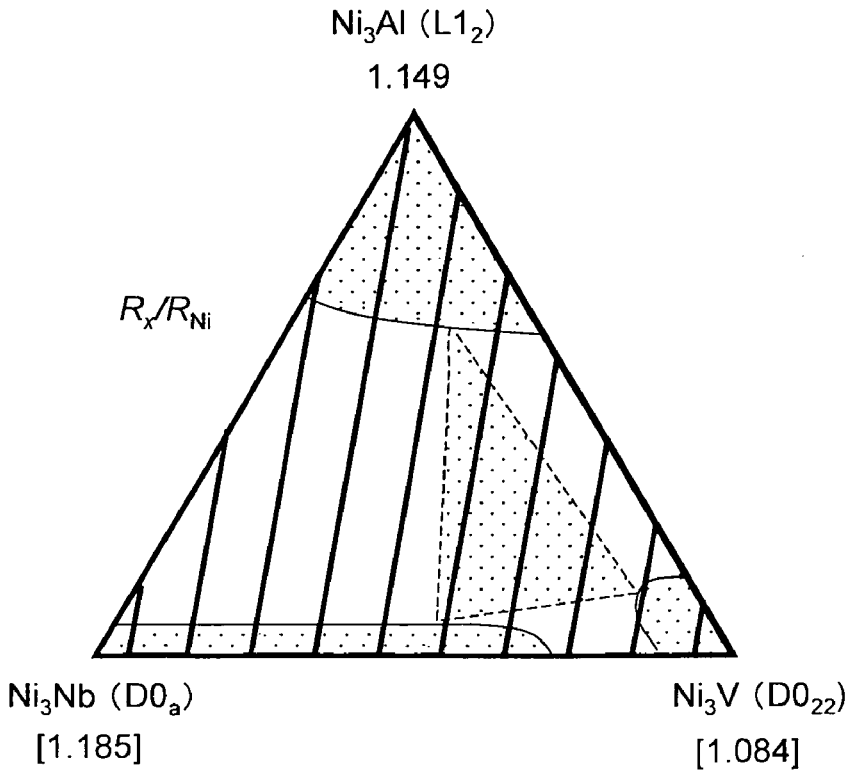

The electron concentration (e/a) of $Ni_3X$ changes from 8.25 to 8.75 increasingly in order of $Ni_3Al$ ($L1_2$), $Ni_3Nb$ ($D0_a$), and $Ni_3V$ ($D0_{22}$), and the atomic radius ratio ($R_x/R_{Ni}$) increases as 1.084 ($Ni_3V$), 1.149 ($Ni_3Al$) and 1.185 ($Ni_3Nb$). Contour maps of the electron concentration (e/a) and the atomic radius ratio ($R_x/R_{Ni}$) of the $Ni_3Al$—$Ni_3Nb$—$Ni_3V$ pseudo-ternary alloy are shown in FIGS. 7A and 7B, respectively. The isothermal phase diagram at 1273 K is also shown in FIG. 7. Referring to FIGS. 7A and 7B, it is found that the phase field and the solid-solubility limit at 1273 K expands along the electron concentration (e/a) rather than the atomic radius ratio ($R_x/R_{Ni}$). This indicates that the phase stability of a $Ni_3X$ intermetallic compound phase having a GCP structure is determined by the electron concentration (e/a).

4. Longitudinal Phase Diagram at 2.5 at % of Nb

Figure 8:
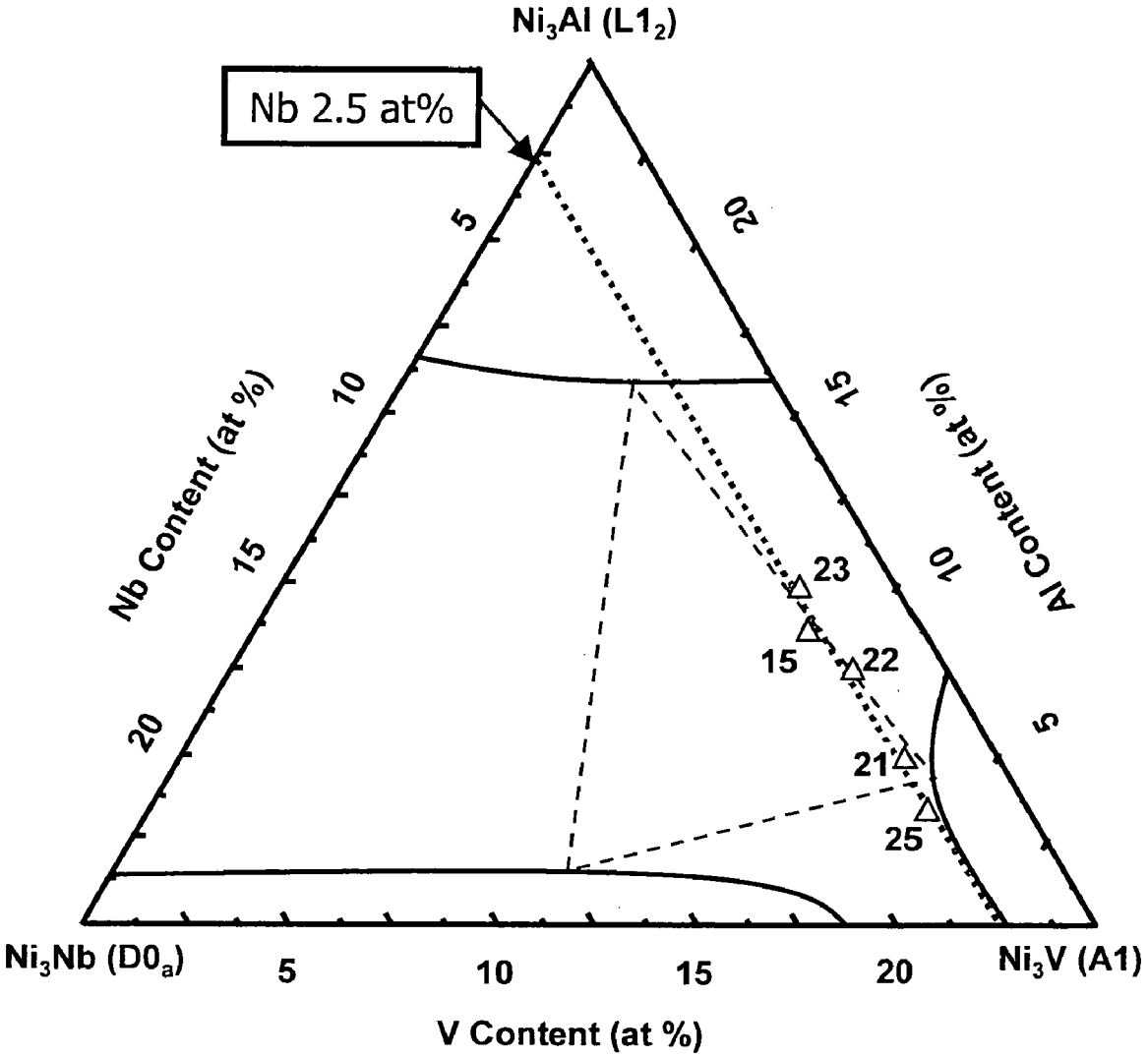
FIG. 8 is a view showing samples of No. 15, No. 21, No. 22, No. 23 and No. 25, respectively, as specific examples of the inventive intermetallic compound, plotted on the isothermal phase diagram of the $Ni_3Al$—$Ni_3Nb$—$Ni_3V$ pseudo-ternary alloy at 1373 K.

Samples each having the composition shown in No. 15, No. 21, No. 22, No. 23 and No. 25, respectively, in Table 4 were prepared by a method similar to that in the aforementioned "1. Method of Preparing Cast Materials". Furthermore, constituent phases (microstructures) of these samples were analyzed by a method similar to that in the aforementioned "2. Isothermal Phase Diagram". The results of analysis are also shown in Table 4. Furthermore, an isothermal phase diagram prepared by plotting the results of these samples on the isothermal phase diagram at 1373 K in FIG. 6 is shown in FIG. 8.

TABLE 4

| | Composition of sample (at %) | | | | |
|---|---|---|---|---|---|
| Sample | Ni | Al | Nb | V | Constituent phases at 1373K |
| 15 | 75 | 8.75 | 3 | 13.25 | $L1_2$ + A1 + $D0_a$ |
| 21 | 75 | 5 | 2.5 | 17.5 | A1 |
| 22 | 75 | 7.5 | 2.5 | 15 | $L1_2$ + A1 |
| 23 | 75 | 10 | 2.5 | 12.5 | $L1_2$ + A1 |
| 25 | 75 | 3 | 2.5 | 19.5 | A1 + $D0_a$ |

Figure 9:
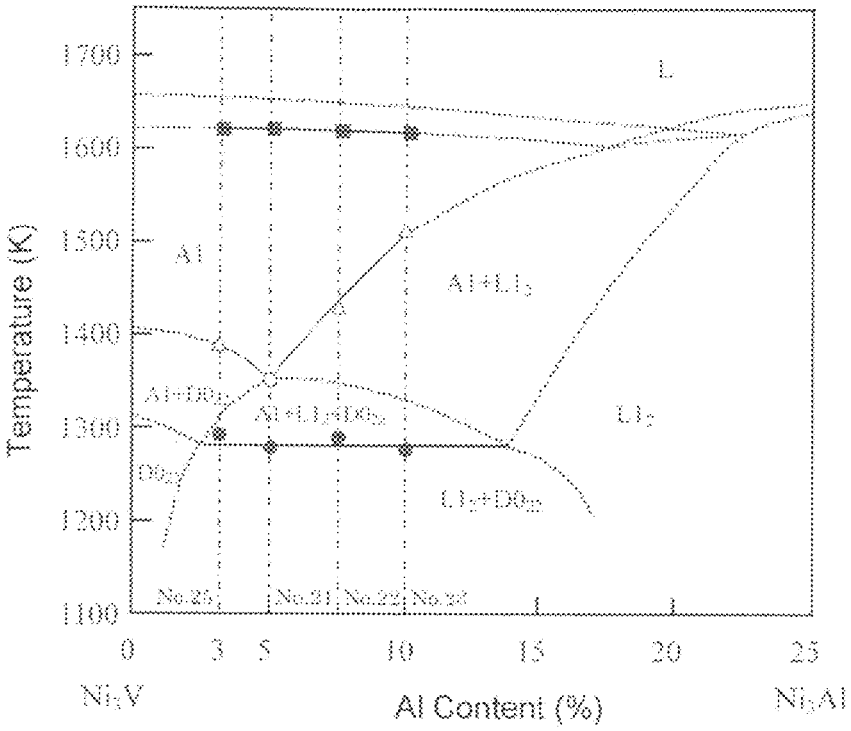
FIG. 9 shows a longitudinal phase diagram of a specific example of the inventive intermetallic compound having a Nb content of 2.5 at % and a V content of (22.5—Al content) at % with the Al content and the temperature being plotted as abscissa and ordinate, respectively.
Figure 10A:
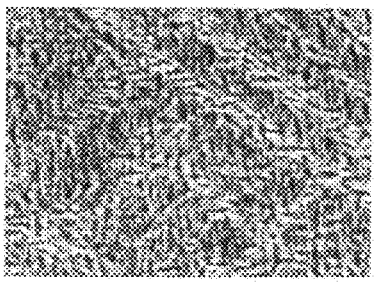
FIGS. 10A to 10D show SEM images of samples of No. 21, No. 22, No. 23 and No. 15, respectively, as specific examples of the inventive intermetallic compound, which were heat-treated at 1373 K for 10 hours and then at 1273 K for 10 hours.
Figure 10B:
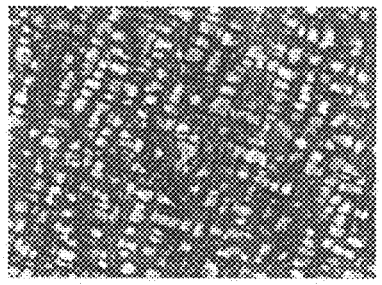
Figure 10C:
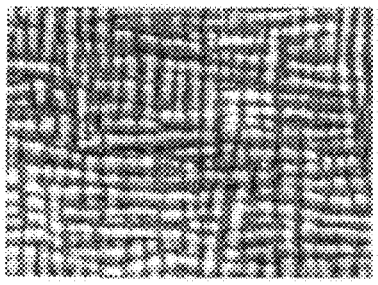
Figure 10D:
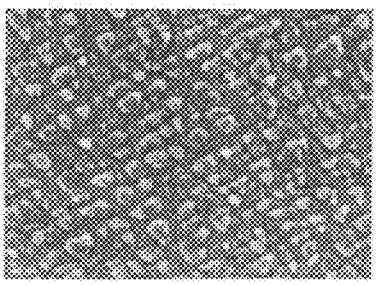

Furthermore, for determination of longitudinal phase diagrams at 2.5 at % of Nb, samples No. 21, No. 22, No. 23 and No. 25 were analyzed by DSC (Differential Scanning Calorimetry). Thereby, a longitudinal phase diagram shown in FIG. 9 was obtained. It is supposed from this longitudinal phase diagram that samples each having an Al content of greater than 5 at % and not greater than 13 at % form an Ni-based superalloy microstructure including A1 and $L1_2$ phases at 1373 K and, when being cooled to a temperature not higher than a eutectoid point, are each imparted a dual multi-phase microstructure comprising a primary $L1_2$ phase and an ($L1_2$+$D0_{22}$) eutectoid microstructure by a eutectoid reaction (Al→$L1_2$+$D0_{22}$).

5. Compression Test

Samples No. 15, No. 21, No. 22 and No. 23 were subjected to a homogenization heat-treatment at 1573 K for 5 hours, heat-treatment at 1373 K for 10 hours, and heat-treatment at 1273 K for 10 hours. Further, samples prepared by adding 500 ppm of B to samples No. 15 and No. 22 (hereinafter these samples are referred to as No. 15B and No. 22B) were subjected to similar heat-treatment. SEM images of the samples subjected to the heat-treatment are shown in FIGS. 10A to 10D, respectively. FIGS. 10A to 10D each corresponds to samples No. 21, No. 22, No. 23 and No. 15, respectively. Samples other than No. 21 having eutectoid composition are found to have a microstructure including a primary $L1_2$ phase and samples No. 15, No. 22 and No. 23 are supposed to have the dual multi-phase microstructure.

Figure 11:
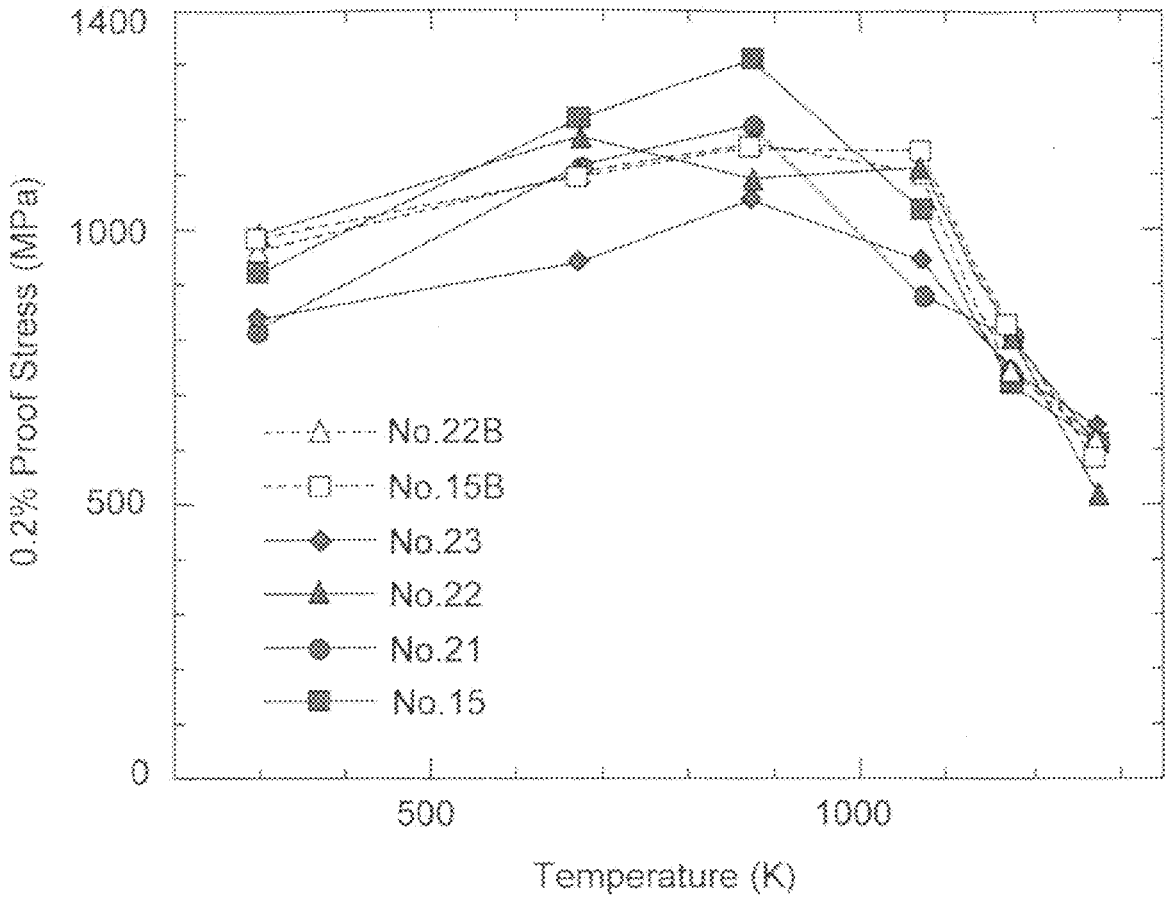
FIG. 11 is a graph showing the results, that is relationships between temperature and 0.2% proof stress, of a compression test for the samples of No. 15, No. 15B, No. 21, No. 22, No. 22B and No. 23, respectively, as specific examples of the inventive intermetallic compound, which were heat-treated at 1373 K for 10 hours and then at 1273 K for 10 hours.

In turn, a compression test was performed for the samples subjected to heat-treatment. The compression test was performed in a vacuum in a temperature range between room temperature and 1273 K at a strain rate of $3.3\times10^{-4}$ $s^{-1}$ with the use of a test piece with a size of $2\times2\times5$ $mm^3$. The results of the compression test are shown in FIG. 11. FIG. 11 is a graph showing relationships between temperature and 0.2% proof stress. All samples held high 0.2% proof stress of about 1 G to 1.3 GPa up to 1073 K and showed a positive temperature dependence of strength. In addition, there was no effect of adding B on 0.2% proof stress.

6. High Temperature Compression Creep Test

Figure 12:
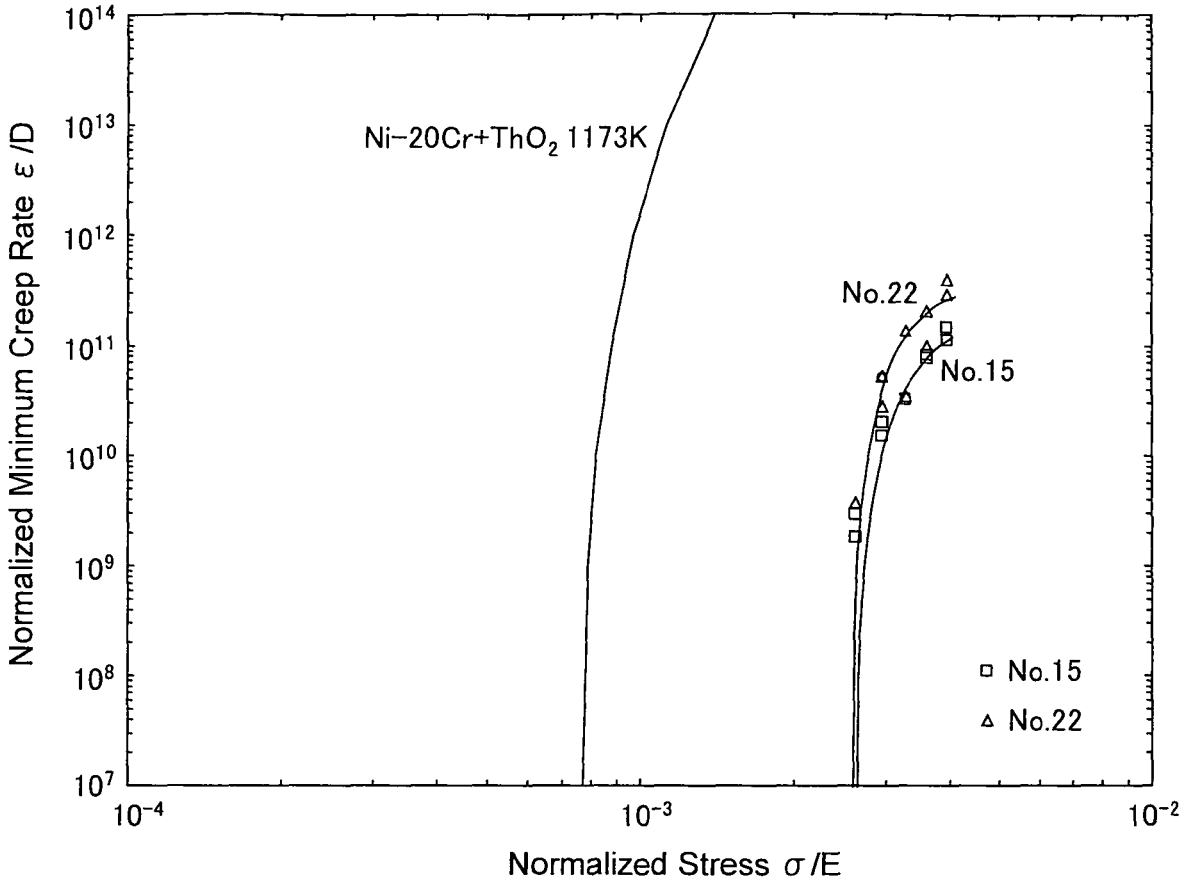
FIG. 12 is a graph showing the results, that is relationships between normalized minimum creep rate and normalized stress, of a high temperature compression creep test for the samples of No. 15B and No. 22B, respectively, as specific examples of the inventive intermetallic compound, which were heat-treated at 1373 K for 10 hours and then at 1273 K for 10 hours.

In turn, a high temperature compression creep test for samples No. 15B and No. 22B subjected to heat-treatment similar to "5. Compression Test" was performed. The high temperature compression creep test was performed in a vacuum in a temperature range between 1150 K and 1200 K with a stress of 400 to 600 MPa using a test piece with a size of $2\times2\times5$ $mm^3$. Relationships between normalized minimum creep rate and normalized stress are shown in FIG. 12. The result of a high temperature tensile creep test performed at 1173 K on Ni-20Cr+$ThO_2$ as a comparative example is also shown in FIG. 12 (In FIG. 12, the E dot indicates the minimum creep rate, the D indicates the diffusion coefficient of Ni in $Ni_3Al$, a indicates the stress, and the E indicates the Young's modulus of $Ni_3Al$). Data for the comparative example is cited from R. W. Land and W. D. Nix, Acta Metall., 24(1976)469.

As is apparent from FIG. 12, samples No. 15B and No. 22B each show a very low creep rate as compared with the comparative example.

Figure 13:
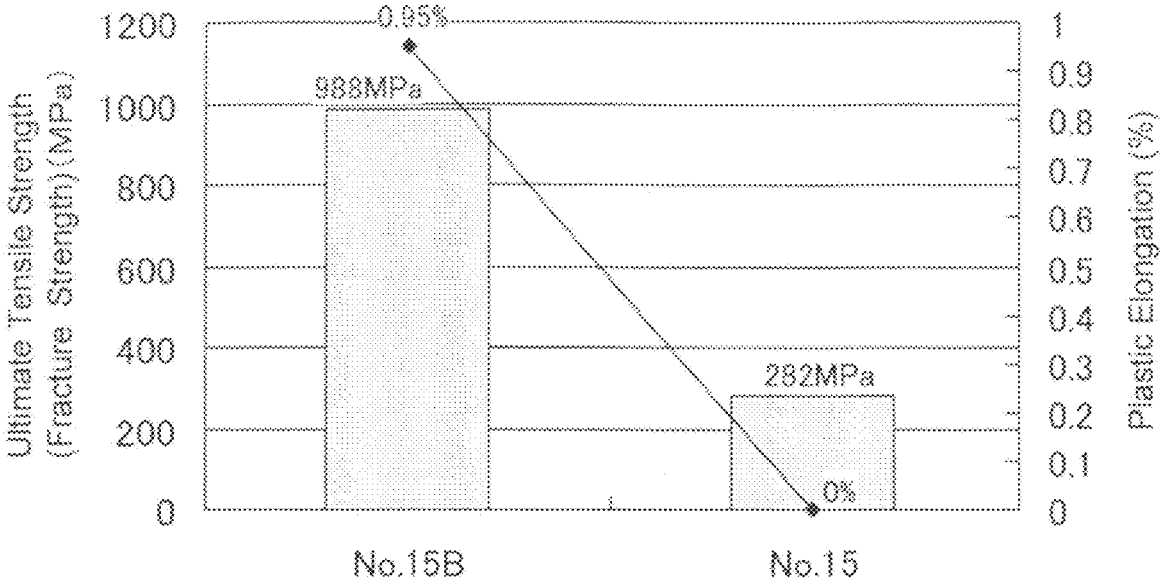
FIG. 13 is a graph showing the results, that is an effect of adding B on ultimate tensile strength and plastic elongation, of a tensile test for the samples No. 15 and No. 15B, as specific examples of the inventive intermetallic compound, which were heat-treated at 1373 K for 10 hours and then at 1273 K for 10 hours.

7. Tensile Test 7-1. Room Temperature Tensile Test of Sample No. 15 and No. 15B A tensile test for samples No. 15 and No. 15B subjected to heat-treatment similar to "5. Compression Test" was performed. The tensile test was performed at room temperature in a vacuum at a strain rate of $1.67\times10^{-4}$ $s^{-1}$ using a test piece with a gage size of $10\times2\times1$ $mm^3$. The results of the test are shown in FIG. 13. Ultimate tensile strength (or fracture strength) and plastic elongation of each sample were shown in FIG. 13.

Referring to FIG. 13, both ultimate tensile strength (or fracture strength) and plastic elongation of the sample No. 15B are much larger than those of the sample No. 15. This result indicates that addition of B is extremely effective in improving the ultimate tensile strength and the plastic elongation.

7-2. Tensile Test of Sample No. 15B and No. 22B

Figure 14A:
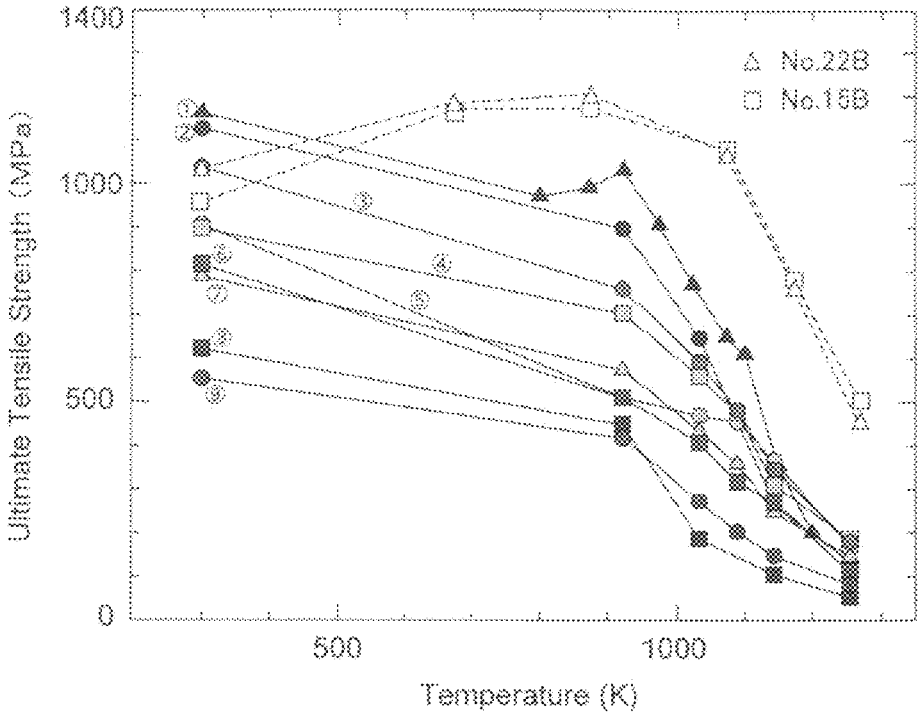
FIGS. 14A and 14B are graphs showing the results of a tensile test for the samples of No. 15B and No. 22B, respectively, as specific examples of the inventive intermetallic compound, which were heat-treated at 1373 K for 10 hours and then at 1273 K for 10 hours.
Figure 14B:
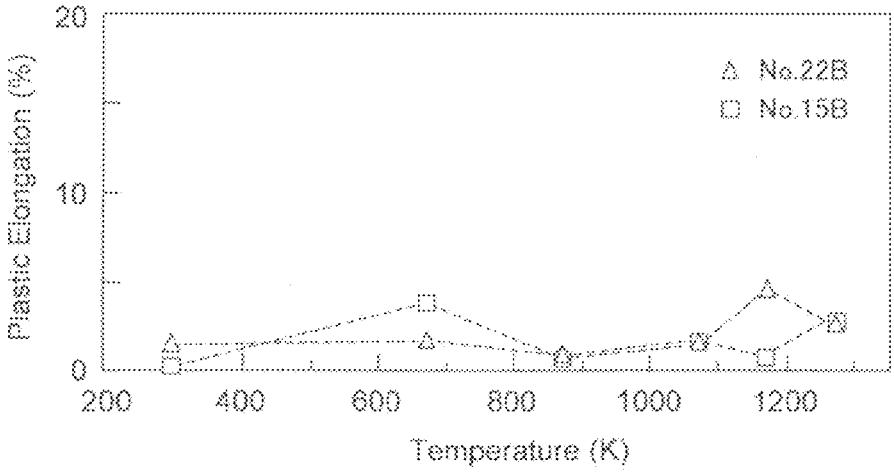
Figure 15A:
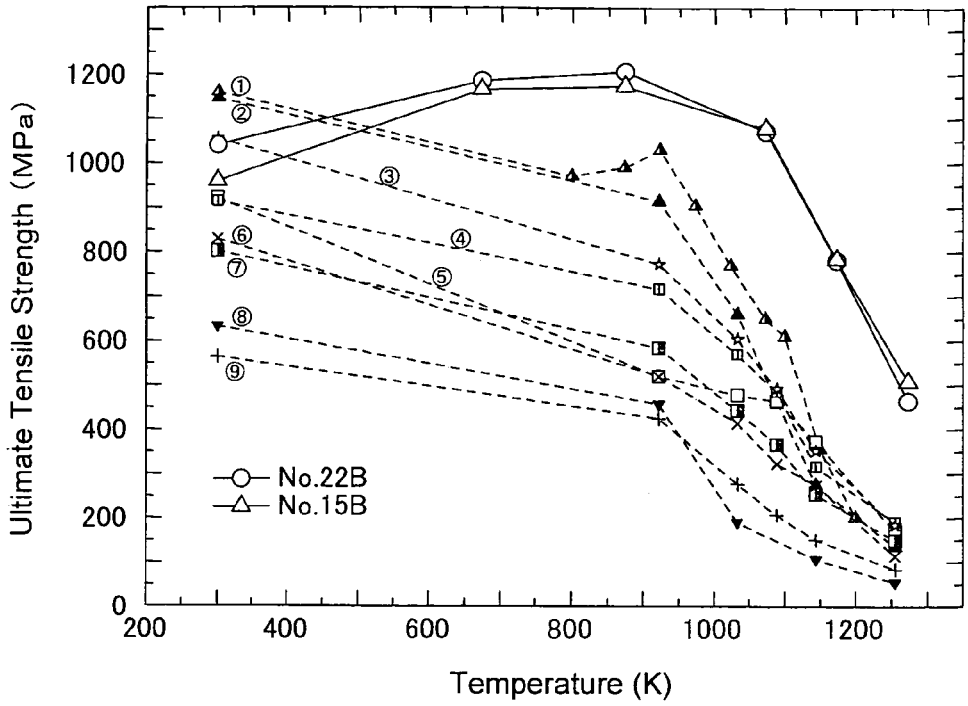
FIGS. 15A and 15B show the results of tensile tests under the same conditions as those in FIGS. 14A and 14B.
Figure 15B:
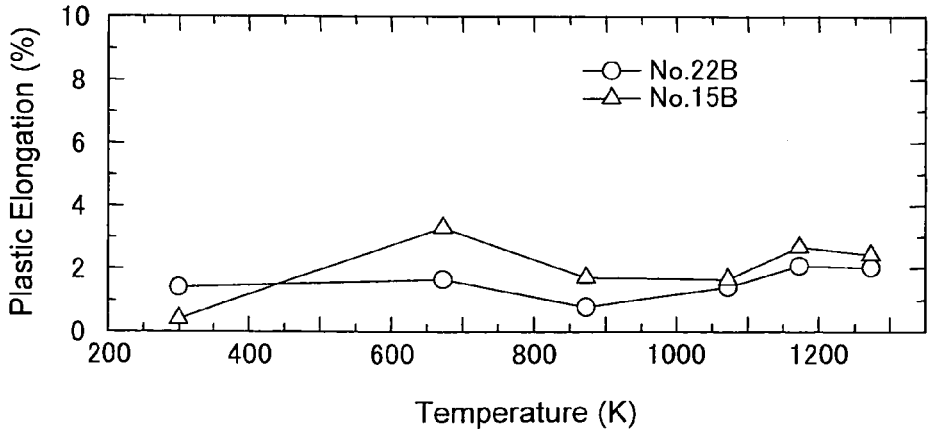

In turn, a tensile test for samples No. 15B and No. 22B subjected to heat-treatment similar to "5. Compression Test" was performed. The tensile test was performed in a vacuum in a temperature range between room temperature and 1173 K at a strain rate of $1.67\times10^{-4}$ $s^{-1}$ using a test piece with a gage size of $10\times2\times1$ $mm^3$. The results of the test are shown in FIGS. 14A and 14B. FIG. 14A is a graph showing relationships between ultimate tensile strength and temperature and FIG. 14B is a graph showing relationships between plastic elongation and temperature. Tensile strength of the various conventional superalloys is also shown in FIG. 14A. In order to confirm the reproducibility, the tensile test was performed again under the same conditions. These results are shown in FIGS. 15A and 15B. FIGS. 15A and 15B correspond to FIGS. 14A and 14B, respectively. Comparing FIGS. 14A and 14B with FIGS. 15A and 15B, it was confirmed that any of the reproducibility of the ultimate tensile strength and the reproducibility of the plastic elongation are high.

In FIG. 14A and FIG. 15A, numerals 1 to 9 denote the following conventional superalloys: (1) Nimonic 263; (2) Inconel X750; (3) S816; (4) Hastelloy C; (5) Hastelloy B; (6) N-155; (7) Haslelloy X; (8) Inconel 600; and (9) Incoloy 800. Data for these superalloys are cited from the Taihei Techno Service's homepage (http://www.taihei-s.com/seihin13.htm). Similar data also appears in Metals Handbook Ninth Edition No. 3, ASM, pp. 187-333 (1980). Referring to FIGS. 14A, 14B, and FIG. 15A, 15B, the inventive intermetallic compounds exhibited high tensile strength of 1200 MPa up to a temperature of 873 K, and kept high tensile strength of 800 MPa at a temperature of 1173 K. Further, in a range of all test temperatures, the inventive intermetallic compounds exhibited plastic elongation of about 0.3 to 4.5% (FIG. 14B) or about 0.4 to 3.3% (FIG. 15B). Thus, the inventive intermetallic compounds are excellent in mechanical strength, and comparable to the various conventional superalloys, and exhibit some plastic elongation.

8. Observation by TEM

Figure 16A:
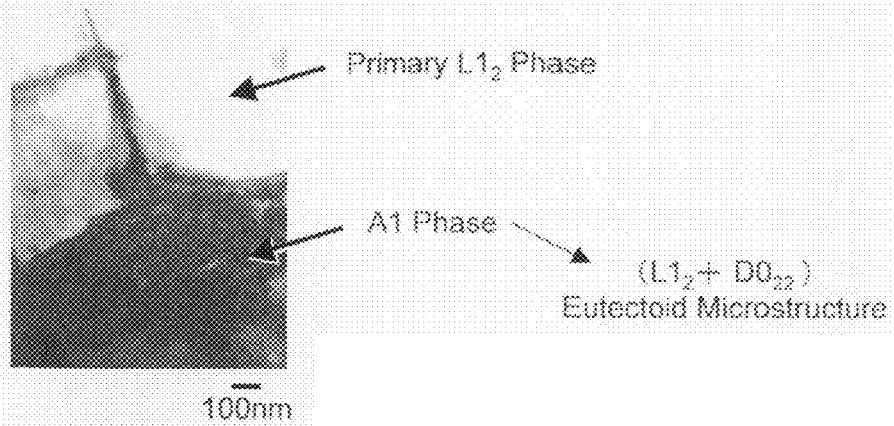
FIG. 16A shows a bright field image and FIG. 16B shows a selected area diffraction pattern for the eutectoid region of a sample No. 15, respectively, as specific examples of the inventive intermetallic compound, which were heat-treated at 1373 K for 10 hours and then at 1273 K for 10 hours.
Figure 16B:
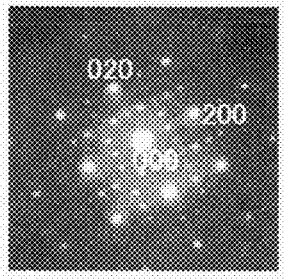

In order to investigate a microstructure in the lower microstructure, a eutectoid region of the sample No. 15 was observed with a TEM. Samples which were subjected to homogenization heat-treatment at 1573 K for 5 hours, heat-treatment at 1373 K for 10 hours, and heat-treatment at 1273 K for 10 hours were used. FIG. 16A shows a TEM bright field image and FIG. 16B shows a selected area diffraction pattern, respectively, for the eutectoid region of the sample No. 15. The sample has a zone axis <001>. Another TEM bright field image and selected area diffraction pattern corresponding to FIGS. 16A and 16B are shown in FIGS. 17A and 17B, respectively.

Figure 17A:
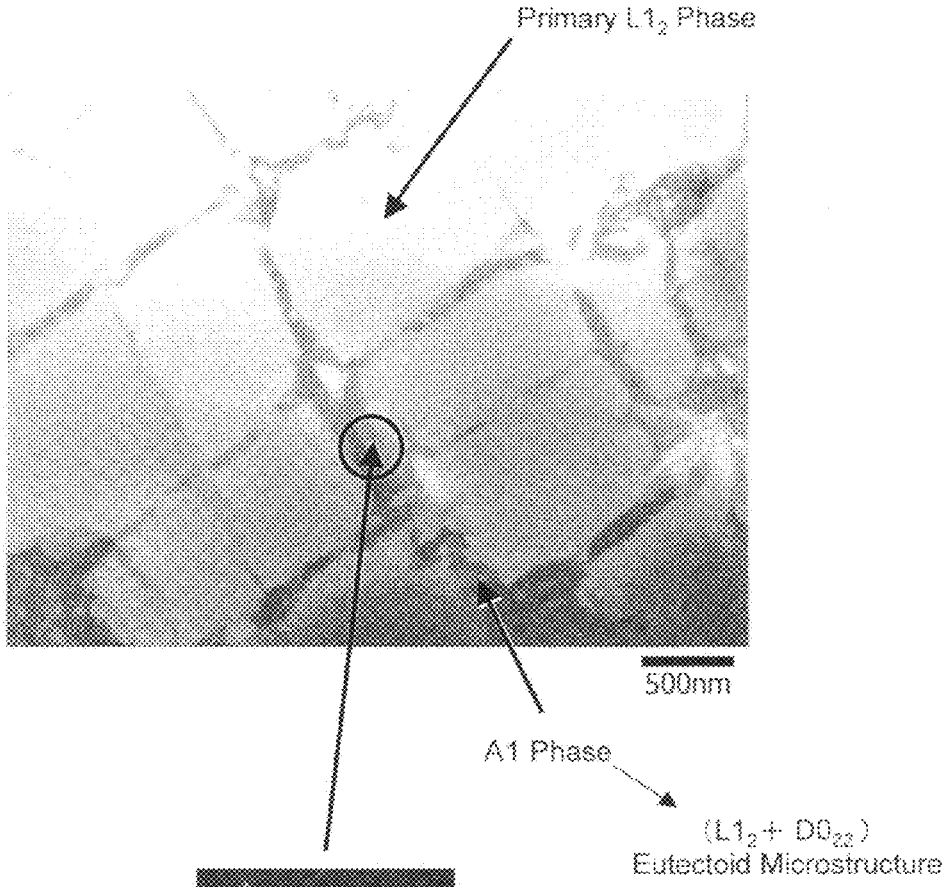
FIGS. 17A and 17B correspond to FIGS. 16A and 16B, respectively.
Figure 17B:
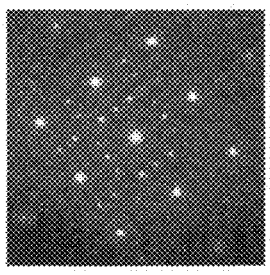

From the diffraction patterns in FIG. 16B and FIG. 17B, it is recognized that the $D0_{22}$ phase and the $L1_2$ phase exist in channels between the cuboidal primary $L1_2$ phases, but in the bright field images in FIG. 16A and FIG. 17A, a formation of a clear microstructure was not found. In addition, it was found from the diffraction patterns that two interfaces between the variants (010) and (100) in the $D0_{22}$ phase are orthogonal to each other and are in a twin crystal relationship.

9. Test for Investigating Effect of Two-Step Heat Treatment

In turn, a test for investigating an effect of two-step heat-treatment was performed. The two-step heat-treatment is a method of heat-treatment in which the first heat-treatment is performed at a primary $L1_2$ phase/A1 phase coexistence temperature or at a primary $L1_2$ phase/A1 phase/$D0_a$ phase coexistence temperature and then the second heat-treatment is performed at an $L1_2$ phase/$D0_{22}$ phase coexistence temperature. It is supposed that by performing the aforementioned second-step heat-treatment, an A1 phase is decomposed into an $L1_2$ phase and a $D0_{22}$ phase with more reliability, and thereby, mechanical properties are improved.

In order to verify the effect of the two-step heat-treatment, a sample of one-step heat-treatment and a sample of two-step heat-treatment were prepared. The sample of one-step heat-treatment was prepared by subjecting the sample No. 15B to a homogenization heat-treatment at 1573 K for 5 hours, to a first heat-treatment at 1373 K for 10 hours, and then subjecting the sample to water-quenching without subjecting it to a second heat-treatment. The sample of two-step heat-treatment was prepared by subjecting the sample No. 15B to a homogenization heat-treatment at 1573 K for 5 hours, to a first heat-treatment at 1373 K for 10 hours, and to a second heat-treatment at 1273 K for 168 hours, and then subjecting the sample to water-quenching.

Figure 18:
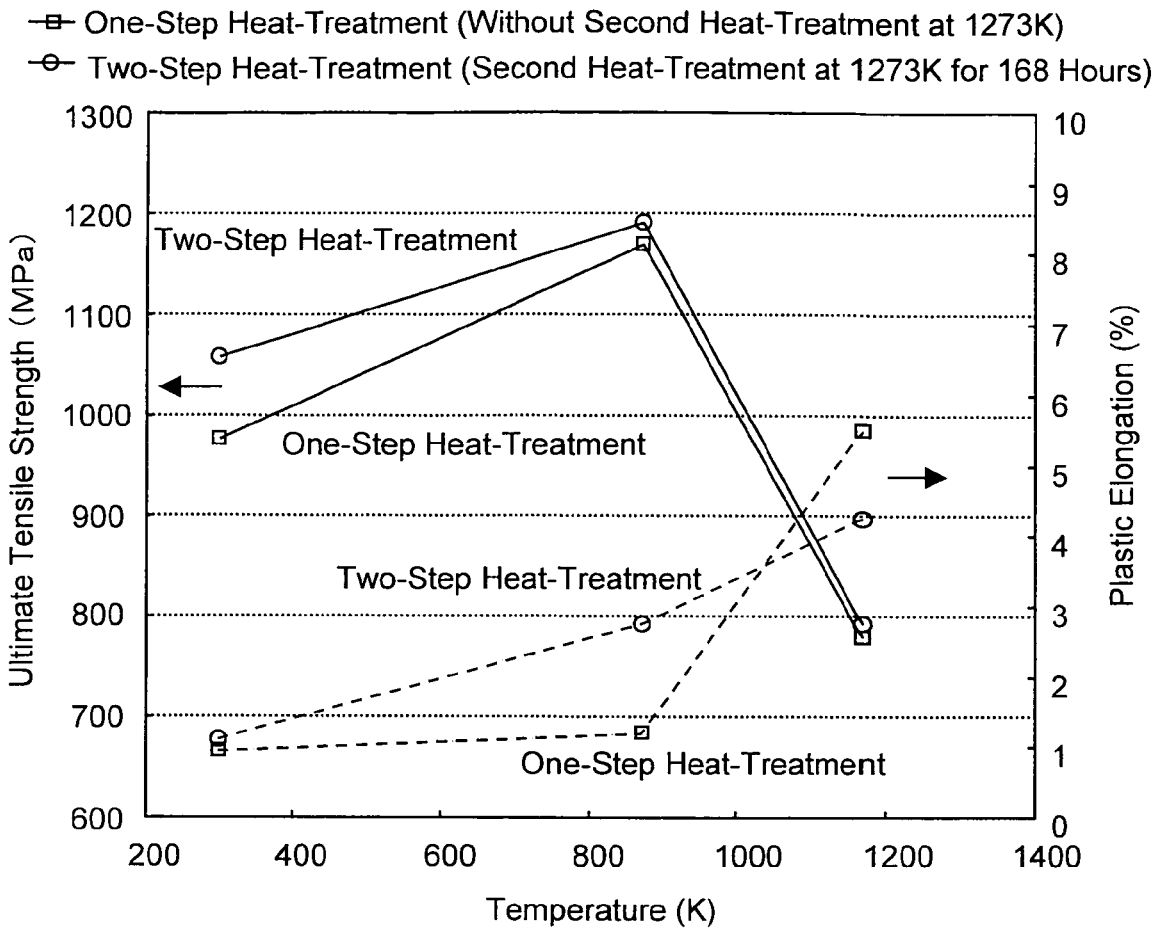
FIG. 18 is a graph showing the results, that is relationships between ultimate tensile strength or plastic elongation and temperature, of a tensile test for a sample of one-step heat-treatment (not subjected to a second heat-treatment at 1273 K) and a sample of two-step heat-treatment (a second heat-treatment at 1273 K for 168 hours) as specific examples of the inventive intermetallic compound.

A tensile test for the sample of one-step heat-treatment and the sample of two-step heat-treatment was performed. The tensile test was performed in a vacuum in a temperature range between room temperature and 1173 K at a strain rate of $1.67\times10^{-4}$ $s^{-1}$ using a test piece with a gage size of $10\times2\times1$ $mm^3$. The results of the test are shown in FIG. 18. FIG. 18 is a graph showing relationships between ultimate tensile strength or plastic elongation and temperature.

According to FIG. 18, in all test temperatures, the ultimate tensile strength of the sample of two-step heat-treatment is higher than that of the sample of one-step heat-treatment. Further, the plastic elongation of the sample of two-step heat-treatment is higher than that of the sample of one-step heat-treatment up to a temperature of about 1000 K. This result indicates that by subjecting the sample to the two-step heat-treatment, the ultimate tensile strength is improved in all test temperatures, and the plastic elongation at relatively low temperature is improved, and therefore the effect of the two-step heat-treatment was verified.

The invention claimed is:

1. A method of producing an $Ni_3Al$-based intermetallic compound comprising the steps of:

performing a first heat-treatment to heat-treat an alloy material comprising greater than 5 at % and not greater than 13 at % of Al, not less than 9.5 at % and less than 17.5 at % of V, 0.5 to 5 at % of Nb, 50 to 1000 weight ppm of B, and the remaining portion being Ni and inevitable impurities at a primary $L1_2$ phase/A1 phase coexistence temperature at which a primary $L1_2$ phase and an A1 phase coexist, or at a primary $L1_2$ phase/A1 phase/$D0_a$ phase coexistence temperature at which a primary $L1_2$ phase, an A1 phase and a $D0_a$ phase coexist; and performing a second heat-treatment to heat-treat the resulting alloy material at the $L1_2$phase/$D0_{22}$ phase coexistence temperature, whereby the A1 phase is transformed into an ($L1_2$+$D0_{22}$) eutectoid structure to form a dual multi-phase microstructure, wherein the second heat-treatment is performed at 1173 to 1273K.

2. The method of claim 1, wherein, in the alloy material, the content of Al is 6 to 10 at %, the content of V is 12 to 16.5 at %, the content of Nb is 1 to 4,5 at %, and the content of B is 200 to 800 weight ppm.

* * * * *